United States Patent [19]

Dillon

[11] 4,095,380

[45] * Jun. 20, 1978

[54] BUILDING AND ELEVATOR MODULE FOR USE THEREIN

[75] Inventor: Thomas J. Dillon, Akron, Ohio

[73] Assignee: Forest City Dillon, Inc., Cleveland, Ohio

[ * ] Notice: The portion of the term of this patent subsequent to Jun. 25, 1991, has been disclaimed.

[21] Appl. No.: 651,460

[22] Filed: Jan. 22, 1976

Related U.S. Application Data

[60] Division of Ser. No. 302,678, Nov. 1, 1972, Pat. No. 3,818,660, and a continuation of Ser. No. 482,320, Jun. 24, 1974, abandoned.

[51] Int. Cl.[2] ..... E04H 1/12

[52] U.S. Cl. ..... 52/79.13; 52/30; 52/79.11; 52/236.8; 187/95

[58] Field of Search ..... 187/1 R, 2, 95, 94; 52/30, 79, 227, 236, 439, 442, 79.1, 79.9, 79.11, 79.13, 236.8

[56] References Cited

U.S. PATENT DOCUMENTS

| | | | |
|---|---|---|---|
| 1,864,093 | 6/1932 | Prince | 187/95 X |
| 3,530,626 | 9/1970 | Mezes | 52/236 X |
| 3,643,390 | 2/1972 | Shelley | 52/79 |
| 3,712,008 | 1/1973 | Georgiev et al. | 52/79 |
| 3,818,660 | 6/1974 | Dillon | 52/79 X |
| 3,882,649 | 5/1975 | Mah et al. | 52/79 |

FOREIGN PATENT DOCUMENTS

| | | | |
|---|---|---|---|
| 229,647 | 12/1958 | Australia | 187/2 |
| 1,570,002 | 6/1969 | France | 187/95 |
| 1,129,524 | 10/1968 | United Kingdom | 187/1 R |

*Primary Examiner*—Evon C. Blunk
*Assistant Examiner*—James L. Rowland
*Attorney, Agent, or Firm*—Reese Taylor

[57] ABSTRACT

Elevator modules for use with an improved overall building system which consists of field assembled precast components reinforcing means embedded within site-poured concrete that forms portions of the wall and floor surfaces of the building, with the reinforcing means serving to structually unite the precast concrete components with the site-poured concrete and support the same against tension, shear and lateral shifting forces are disclosed. The elevator modules are precast components themselves having opposed front and rear walls and opposed side walls each having at least one through vertical void therein. The end walls have locating notches disposed in the bottom edges thereof. Some of the other precast components include full and partial thickness floor slabs and the locating notches in the bottom edges of the elevator modules are capable of engaging with and being supported on adjacent full thickness floor slabs. The partial thickness slabs are capable of being supported on the top edges of the elevator modules so that the site-poured concrete can simultaneously bring the partial thickness slabs to full thickness and fill the voids in the walls of the modules to form a monolithic structure.

1 Claim, 42 Drawing Figures

FIG. 18
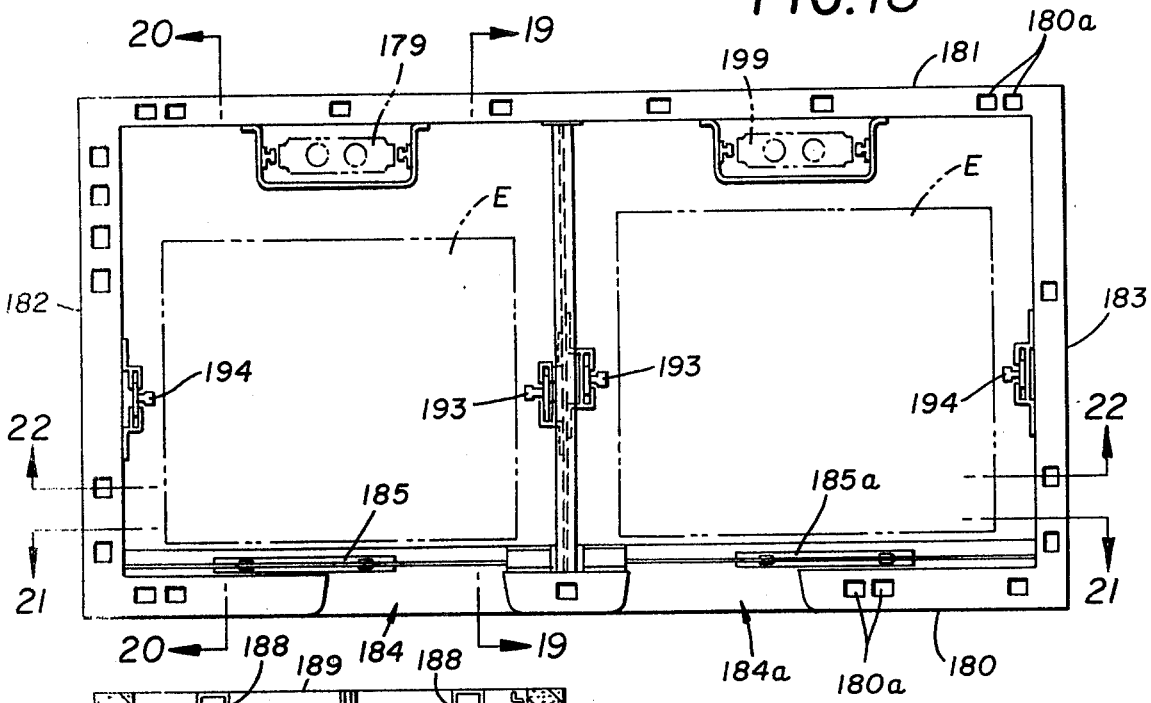
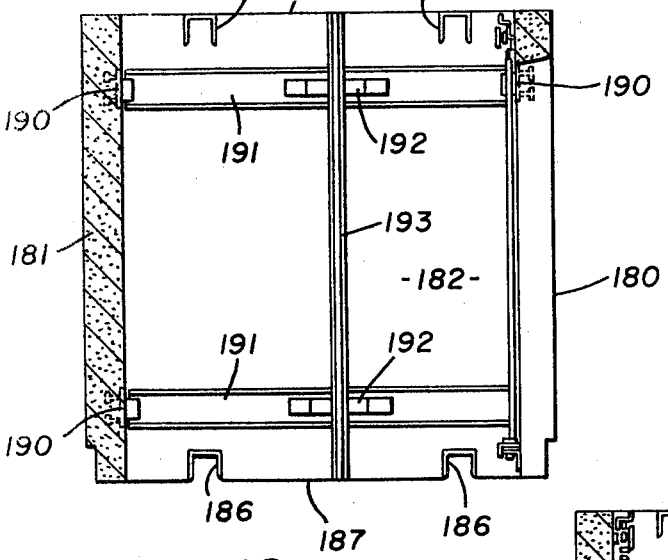
FIG. 19
FIG. 20
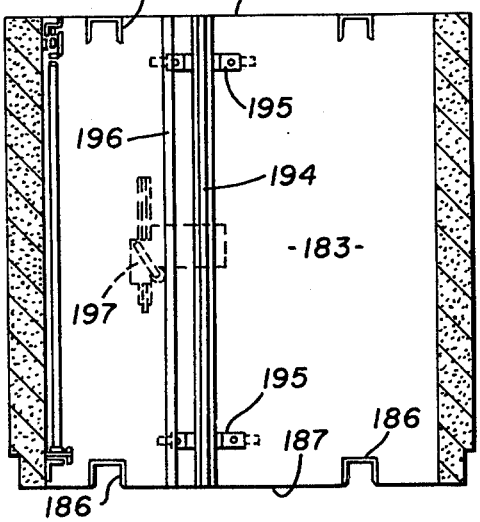

BUILDING AND ELEVATOR MODULE FOR USE THEREIN

This application is a division of application Ser. No. 302,678, filed Nov. 1, 1972, now U.S. Pat. No. 3,818,660, and a continuation of Ser. No. 482,320, filed June 24, 1974 and now abandoned.

RELATED APPLICATIONS

In Dillon U.S. Pat. No. 3,662,506, there was disclosed an arrangement wherein precast bearing walls were united with half thickness floor slabs through the medium of angular reinforcing and site-poured concrete.

In Dillon U.S. Pat. No. 3,906,686 entitled "Pre-Assembled Utility Module", there was disclosed a pre-assembled utility core that was provided on a building slab and contained a bath and kitchen and eating area that was ready to use upon field positioning and connection.

In the presently pending application of Thomas J. Dillon on "Combined Elevator Shaft and Utility Module" filed May 12, 1971, as Ser. No. 142,644, now abandoned and made the subject of continuation application filed Apr. 13, 1973, as Ser. No. 351,016, and now U.S. Pat. No. 3,991,528 there was disclosed a precast, concrete elevator floor module that was designed to be progressively stacked one on top of the other for the purpose of building the requisite elevator shaft concurrently with the erection of the building.

BACKGROUND OF THE INVENTION

The invention relates to the field of building construction either for dwelling or commercial operation a either single story or multi-story nature.

The invention relates in particular to precast elevator modules having hollow core walls and locating notches in their bottom edges and which are intended to be incorporated into a building comprised of precast and site poured concrete and including full and partial thickness precast floor slabs.

SUMMARY OF THE INVENTION

It has been discovered that a new and total building concept can be achieved by improving the basic concepts set forth in the aforesaid Dillon U.S. Pat. No. 3,662,506.

Specifically, it has been found that if the elevator modules are provided with vertical voids therein, the same can be structurally integrated with the remaining components of the overall building, and thus the elevator shafts that result will be structurally united with the building instead of being supported independently thereof as is the normal building procedure.

Finally, it has been found that if the walls are poured separately from the time the floor is poured, this will permit improved placement of the reinforcing means so that additional forces against tension, shear, and seismic forces, as well as forces against lateral shifting, can all be positioned prior to the time the floor is poured in the field.

It has also been found that by utilizing a system of this type, it is possible to use other precast elements such as precast corridor walls and precast balcony slabs, with all of these essential components being tied together in the final pouring of the floor as the building progresses upwardly floor by floor.

It has also been discovered that erecting a building in the manner that will hereinafter be described produces an additional advantage in that a high degree of safety is present to the workmen that are involved since at all times during construction they are provided with a solid surface upon which to stand, with the use of scaffolding of the conventional type being avoided throughout construction.

Production of a totally new and innovative building system concept of the type above described is the principal object of this invention, with other objects of the invention becoming more apparent upon a reading of the following specification, considered and interpreted in the light of the accompanying drawings.

OF THE DRAWINGS:

FIGS. 2 and 3 are perspective views, with FIG. 2 illustrating the position of the shear dowels, tensioning steel, and reinforcing steel and FIG. 3 shear dowels, tensioning steel, and reinforcing steel.

Figure 5:
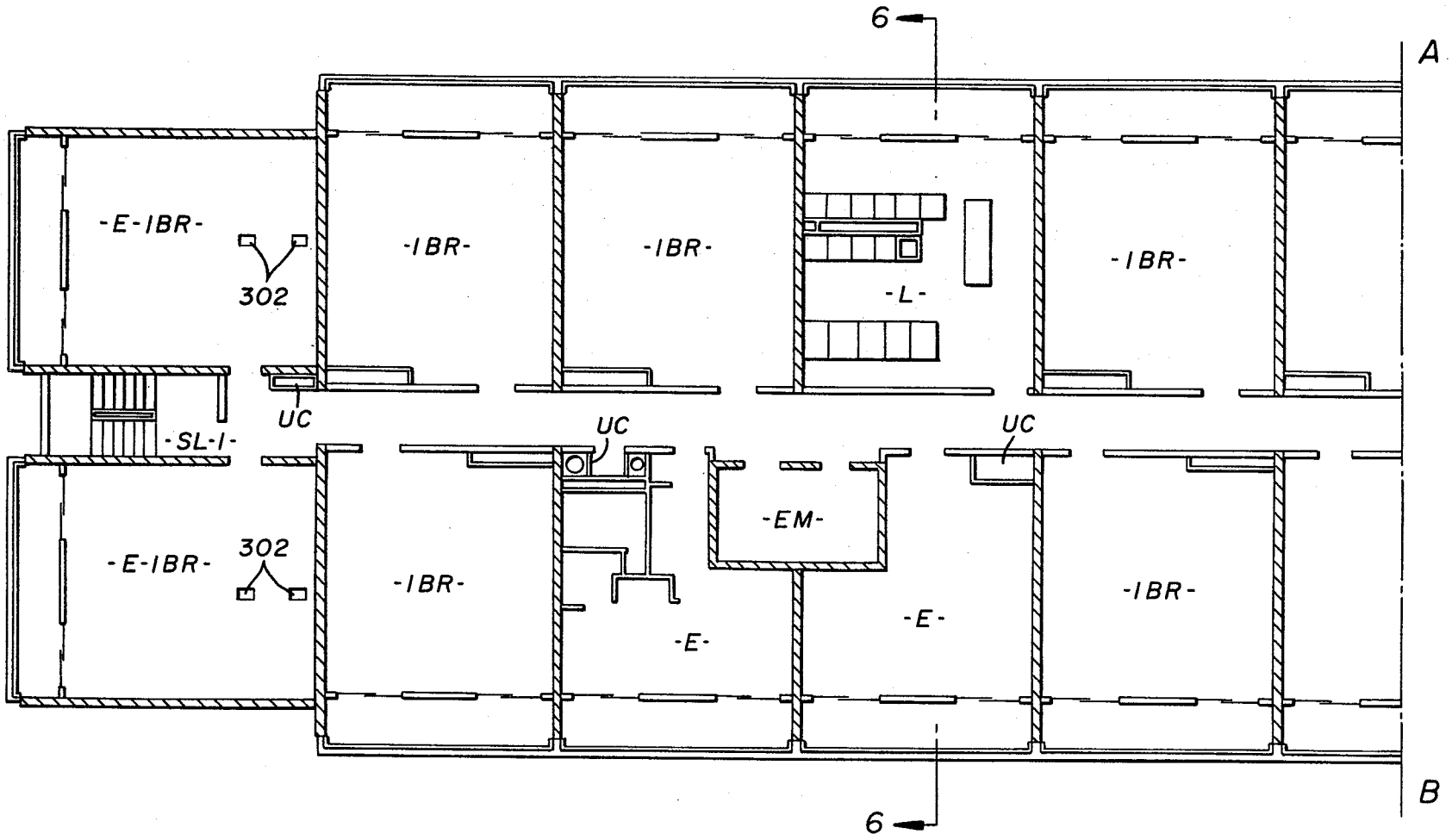
FIG. 5 shows the completed product broken away and in section for clarity.
Figure 5A:
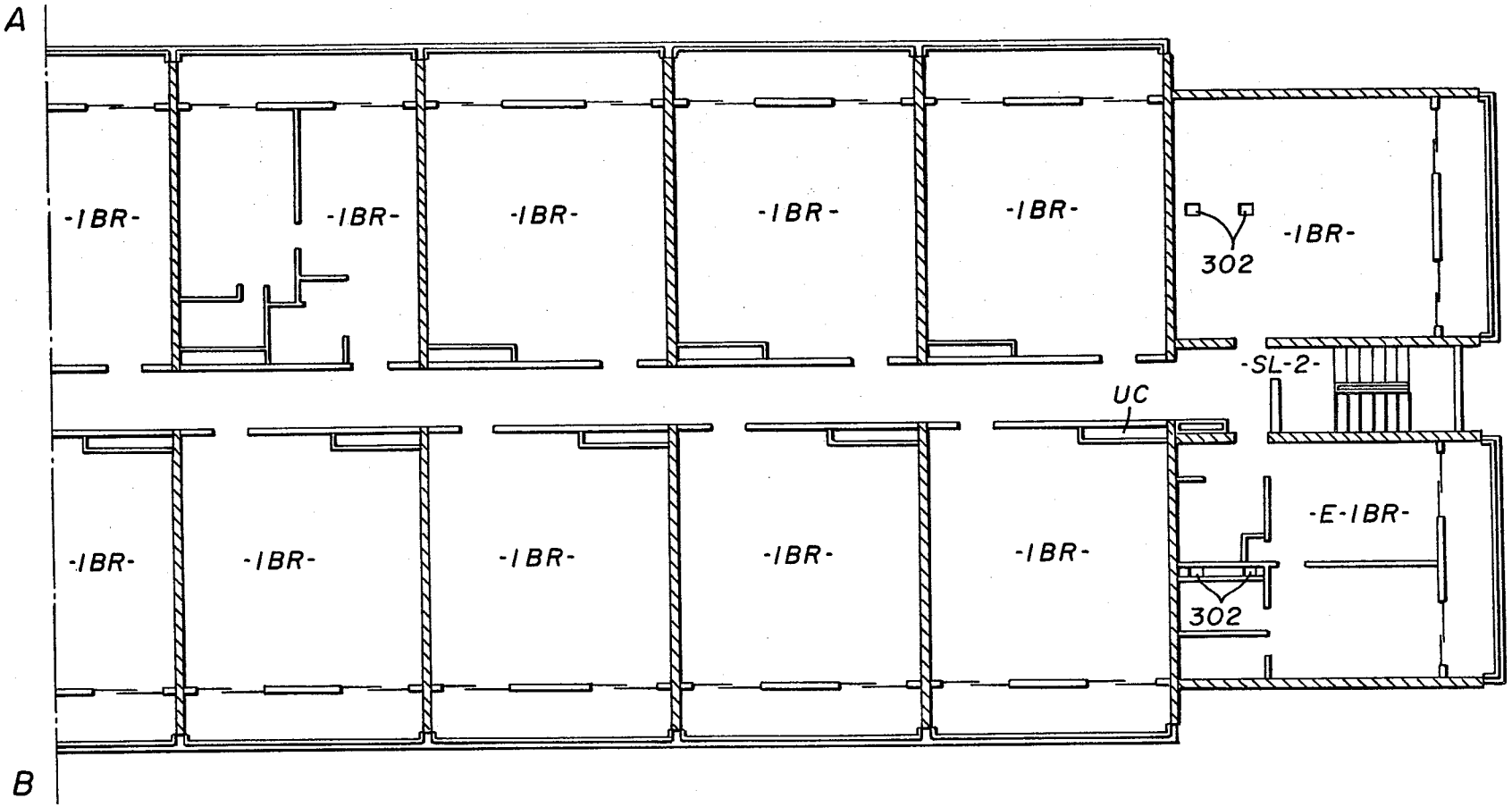
Figure 6:
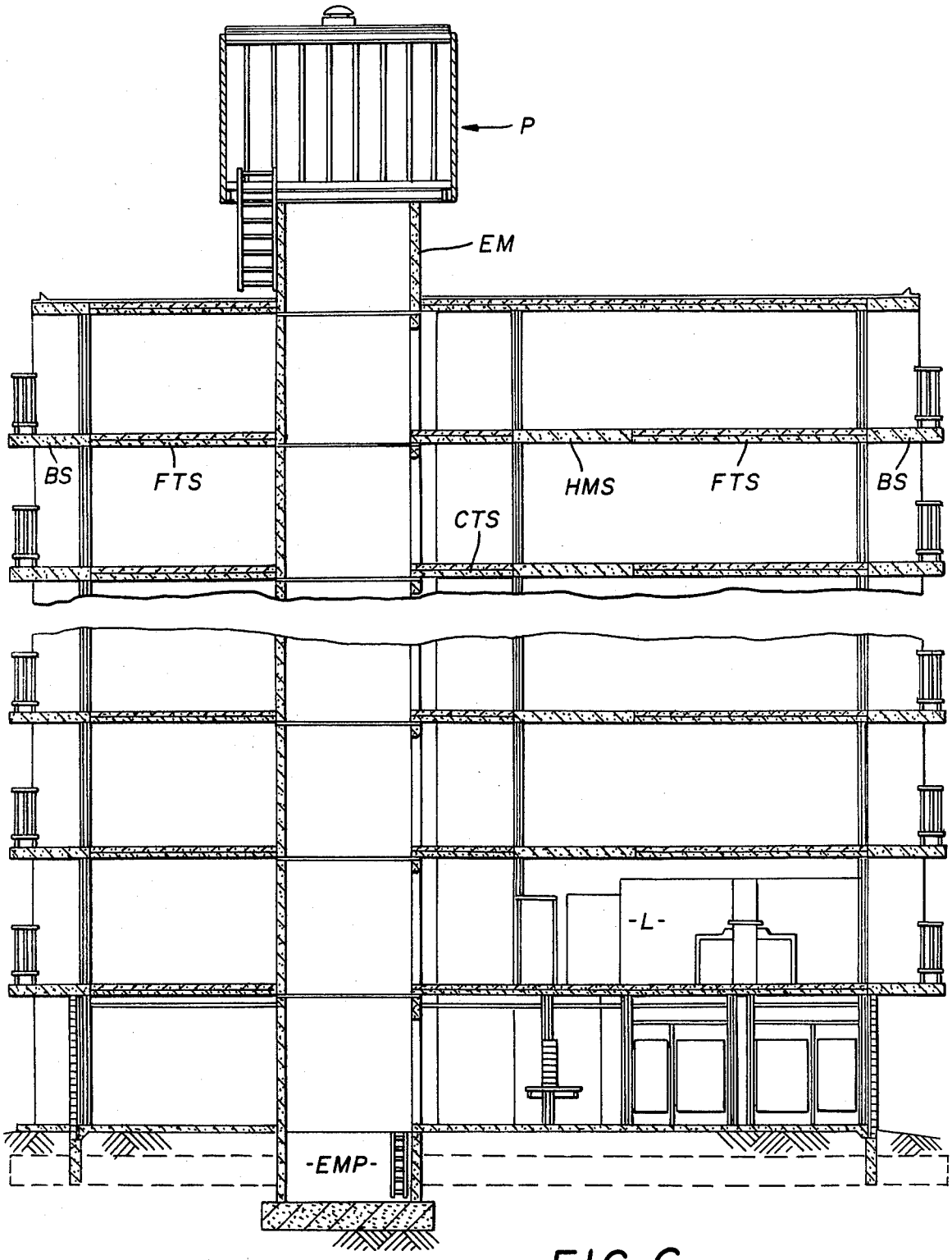

FIGS. 5 and 5A comprise a plan view using match lines A–B to show a typical floor of a building built according to the system of this invention.

Figure 8:
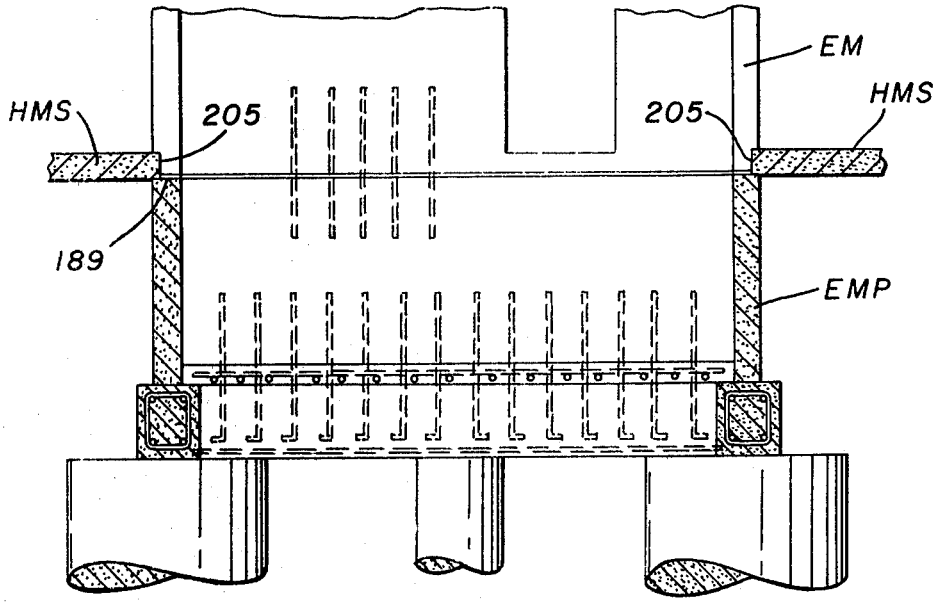

FIG. 8 is a sectional view taken on the lines 8—8 of FIG. 5.

Figure 7:
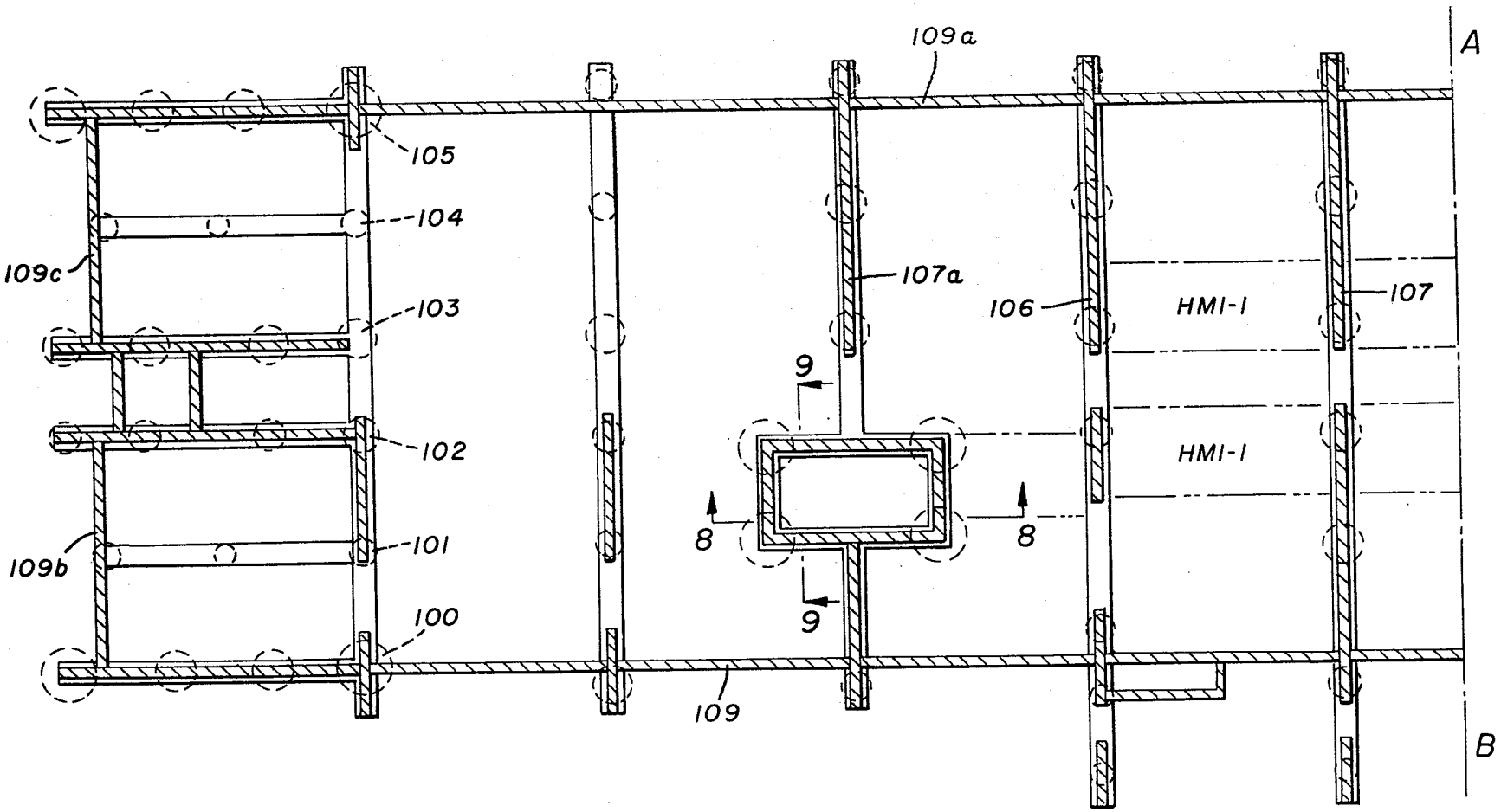
Figure 7A:
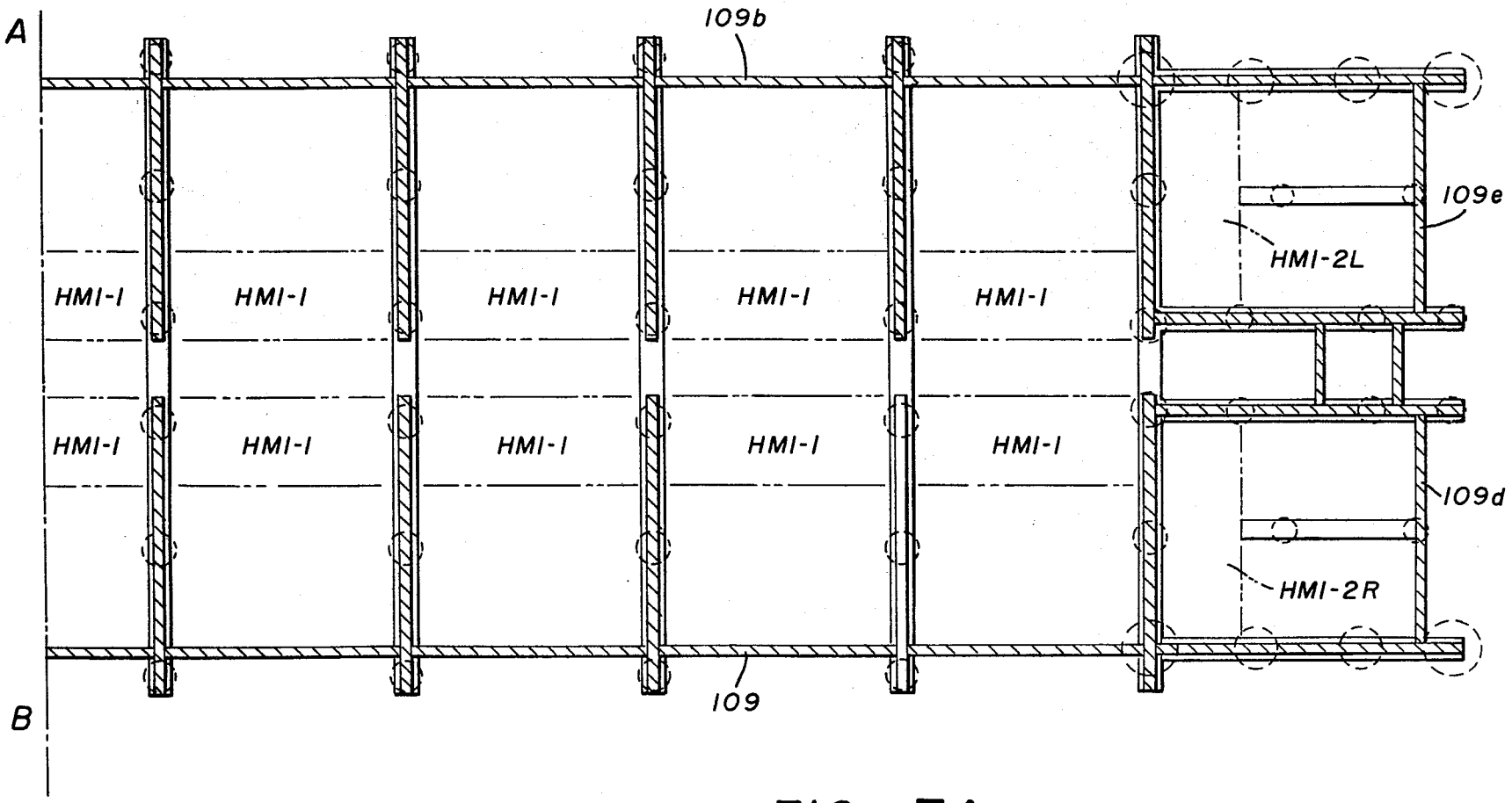

FIGS. 7 and 7A comprise a plan view using match lines A–B to show a foundation plan of the building shown in FIG. 7.

Figure 9:
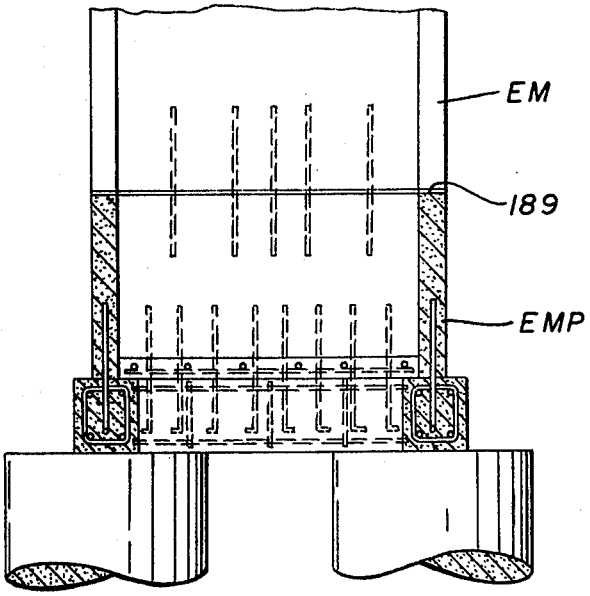

FIGS. 8 and 9 are sectional views taken on the lines 11—11 and 12—12 of FIG. 7.

Figure 4:
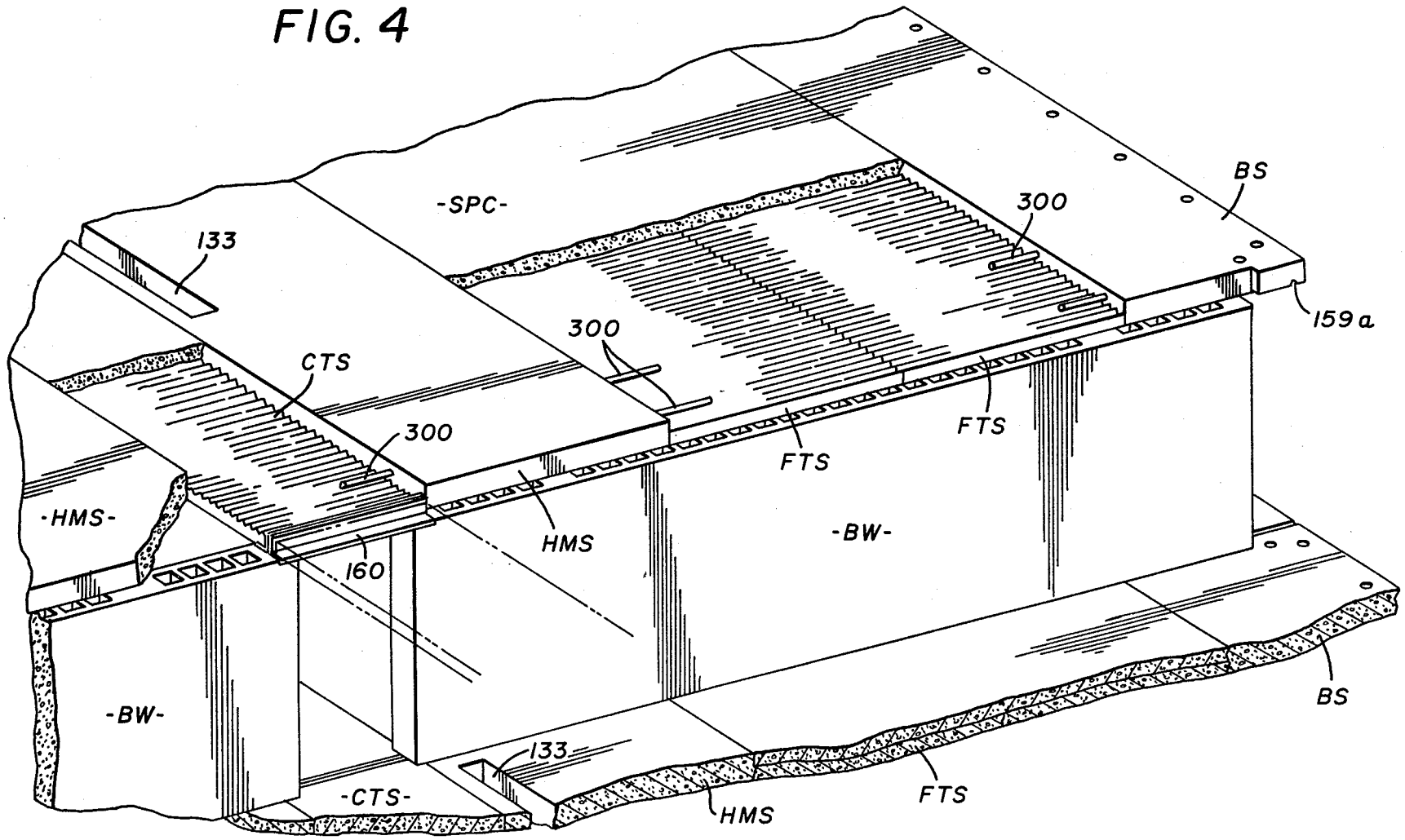
FIG. 4 is a similar perspective view partially broken away in section and showing the manner in which the corridor beams, heart module, floor truss slabs, and balcony slabs are positioned with regard to a typical bearing wall.
Figure 10:
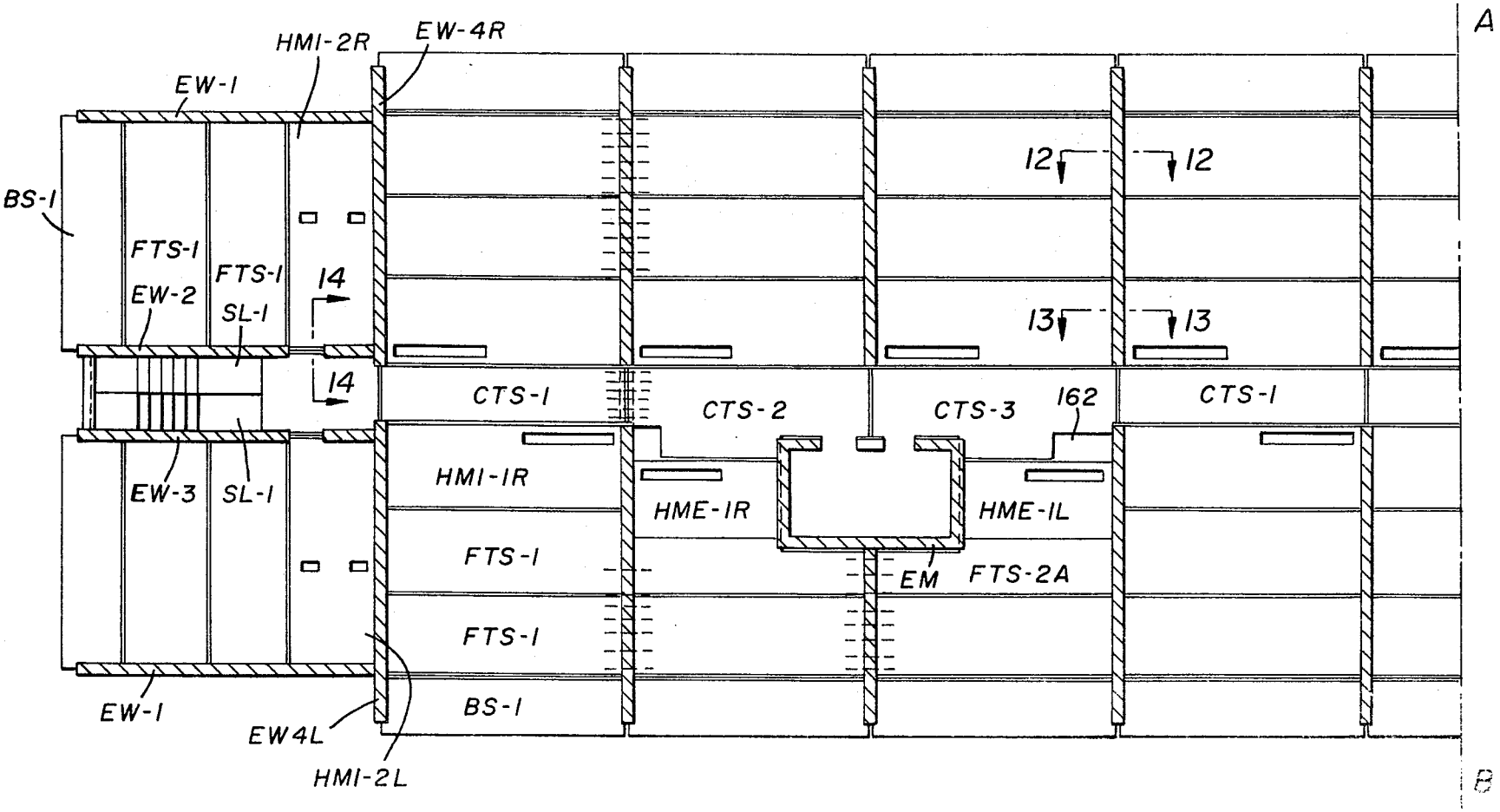
Figure 10A:
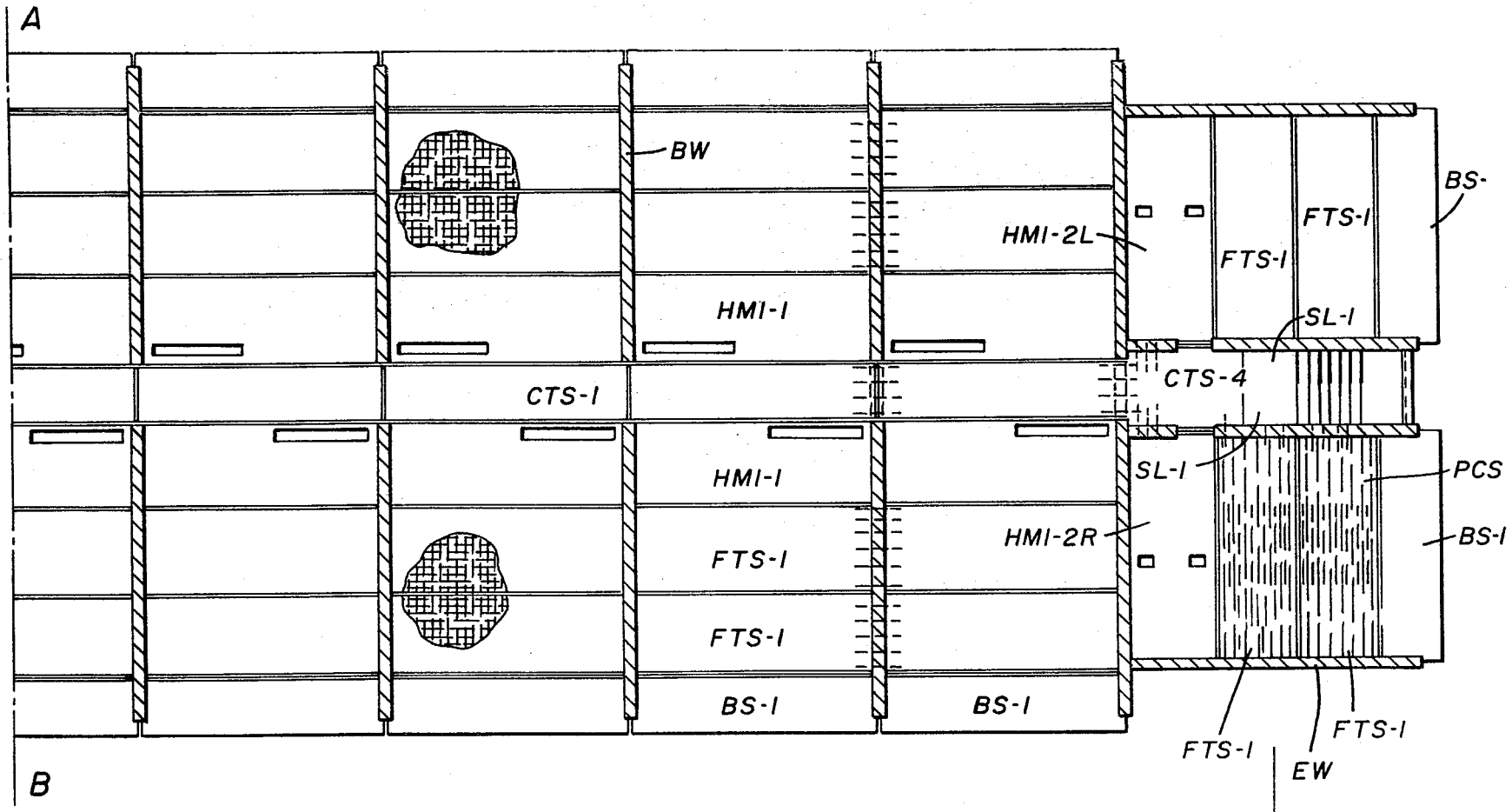

FIGS. 10 and 10A comprise a plan view using match lines A – B to show a structural floor plan showing the first floor of the building illustrated in FIG. 4.

Figure 11:
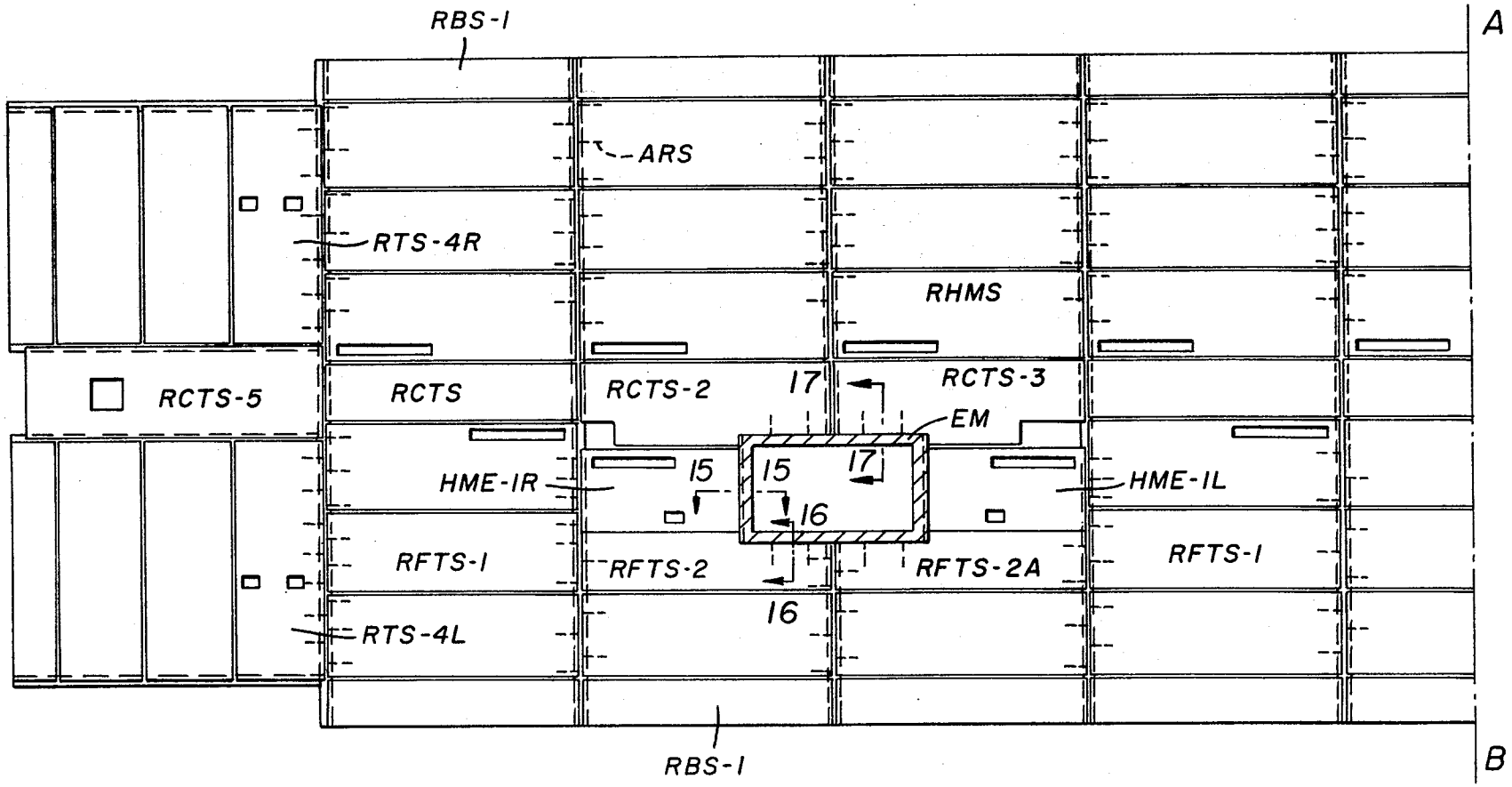
Figure 11A:
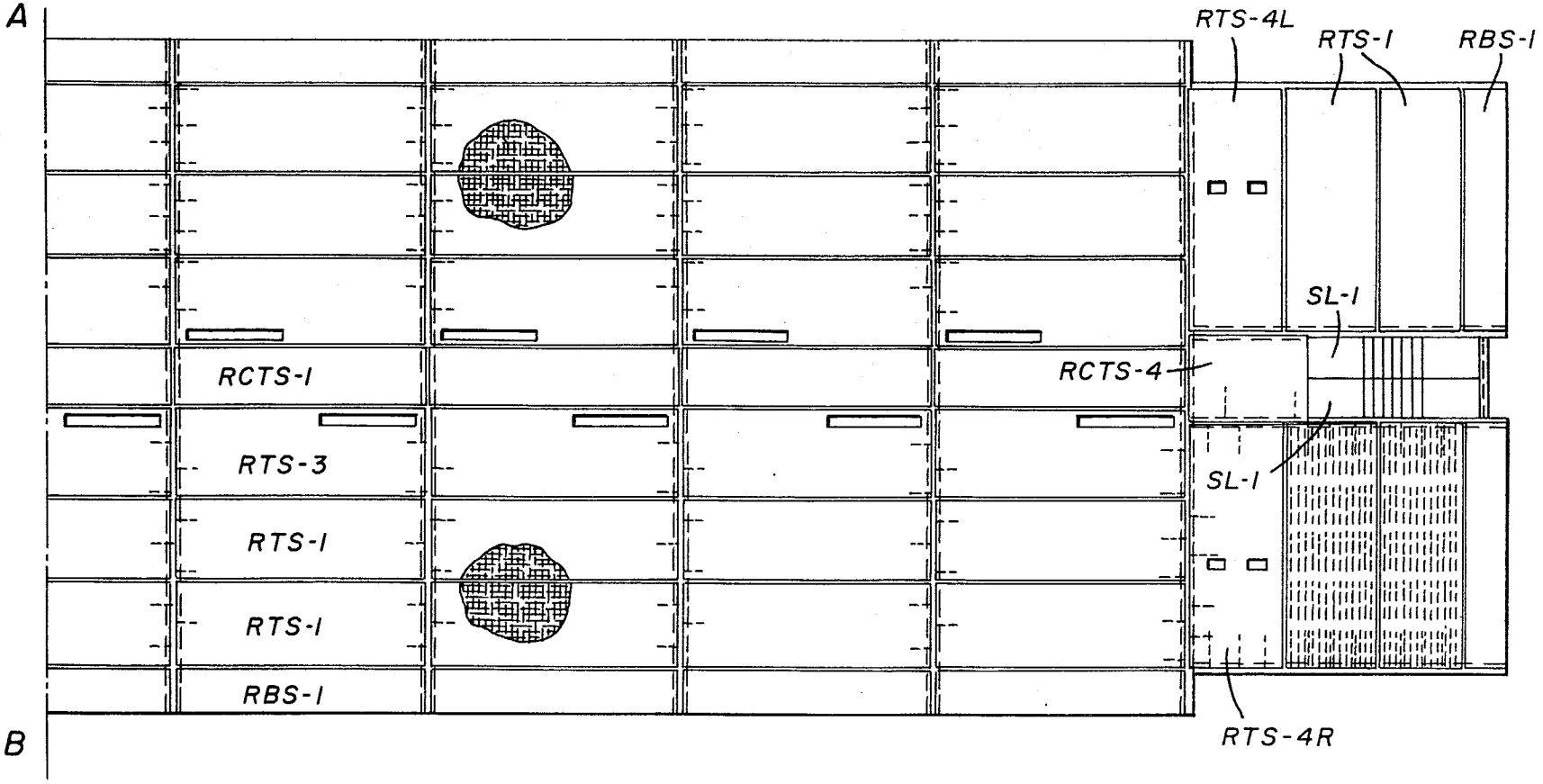

FIGS. 11 and 11A comprise a plan view using match lines A – B to show a structural floor plan showing the roof components of the building illustrated in FIG. 4.

Figure 12:
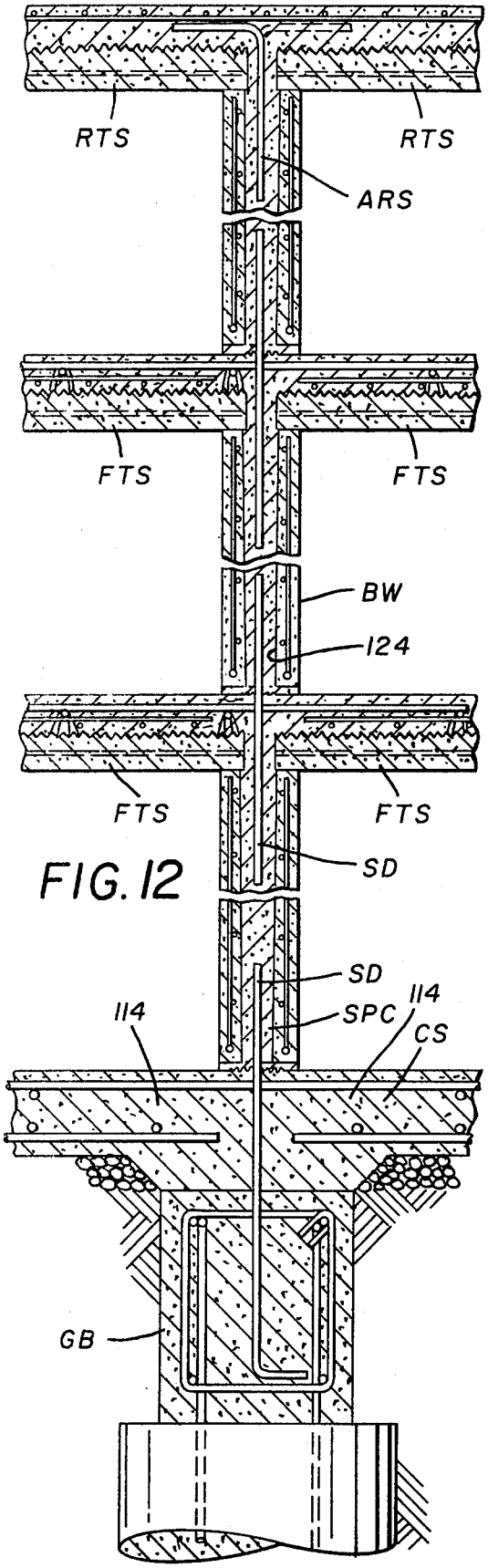
Figure 13:
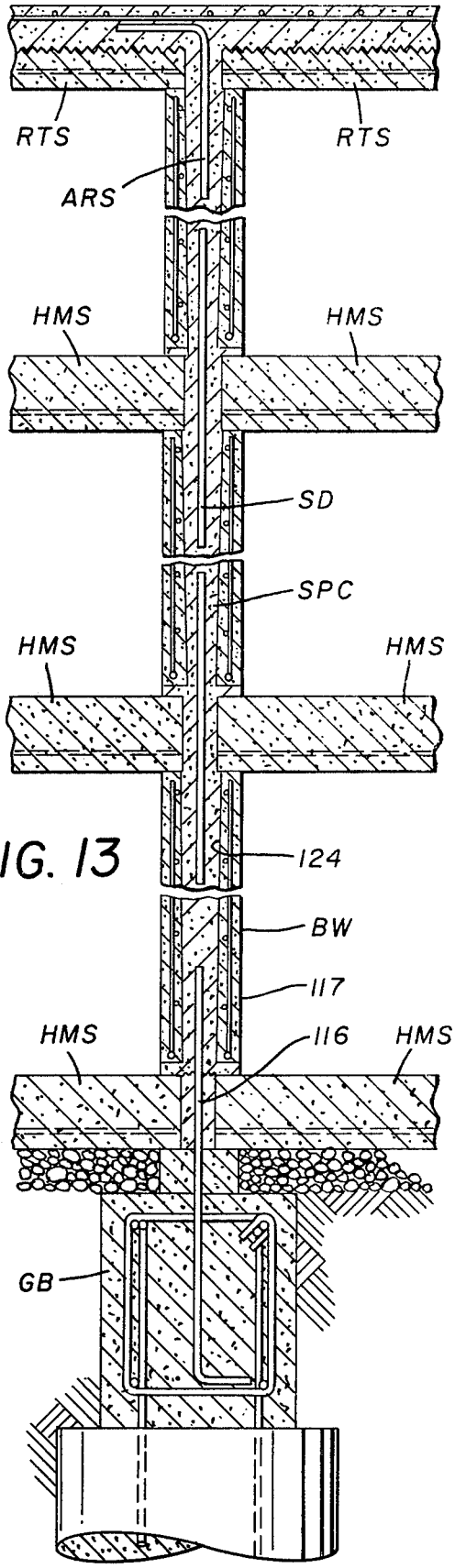
Figure 14:
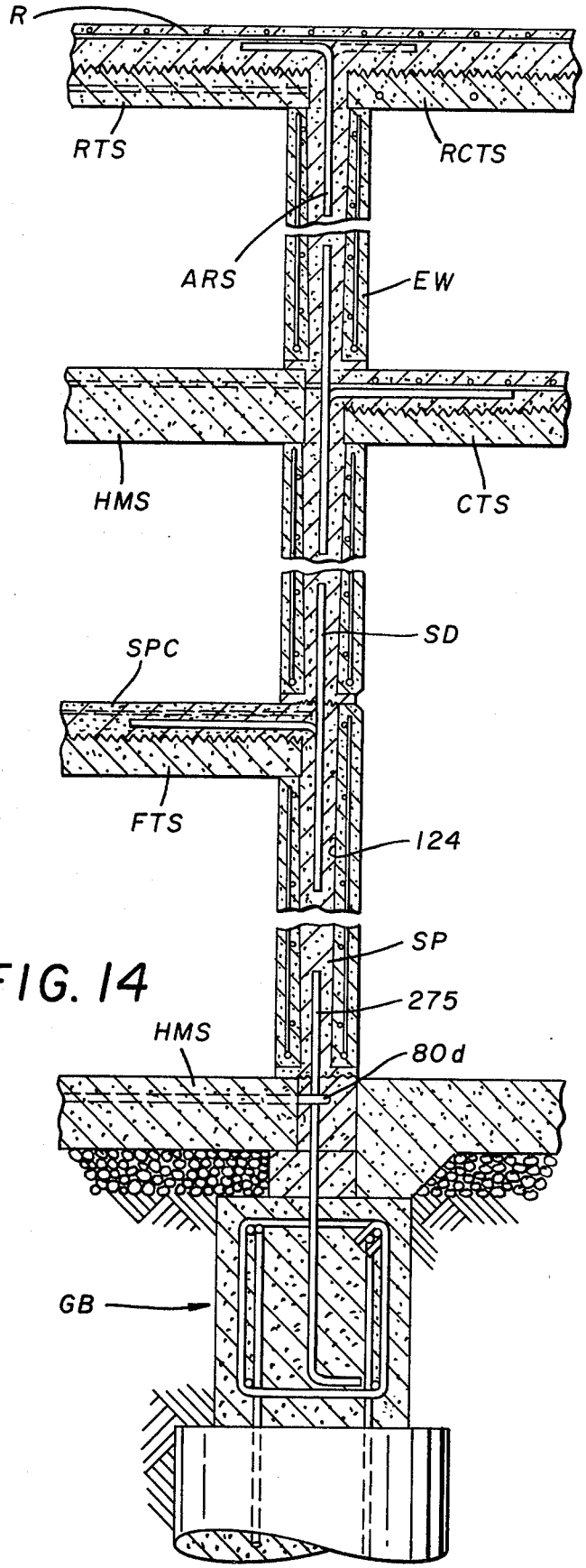

FIGS. 12, 13 and 14 are sectional views taken on the lines 12—12, 13—13 and 14—14 of FIG. 10.

Figure 15:
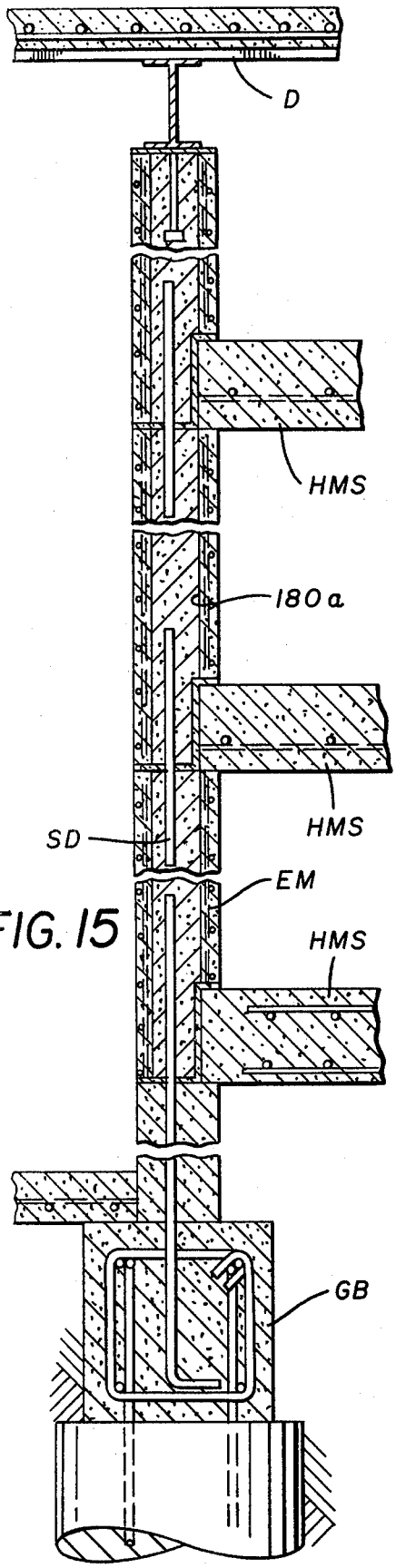
Figure 16:
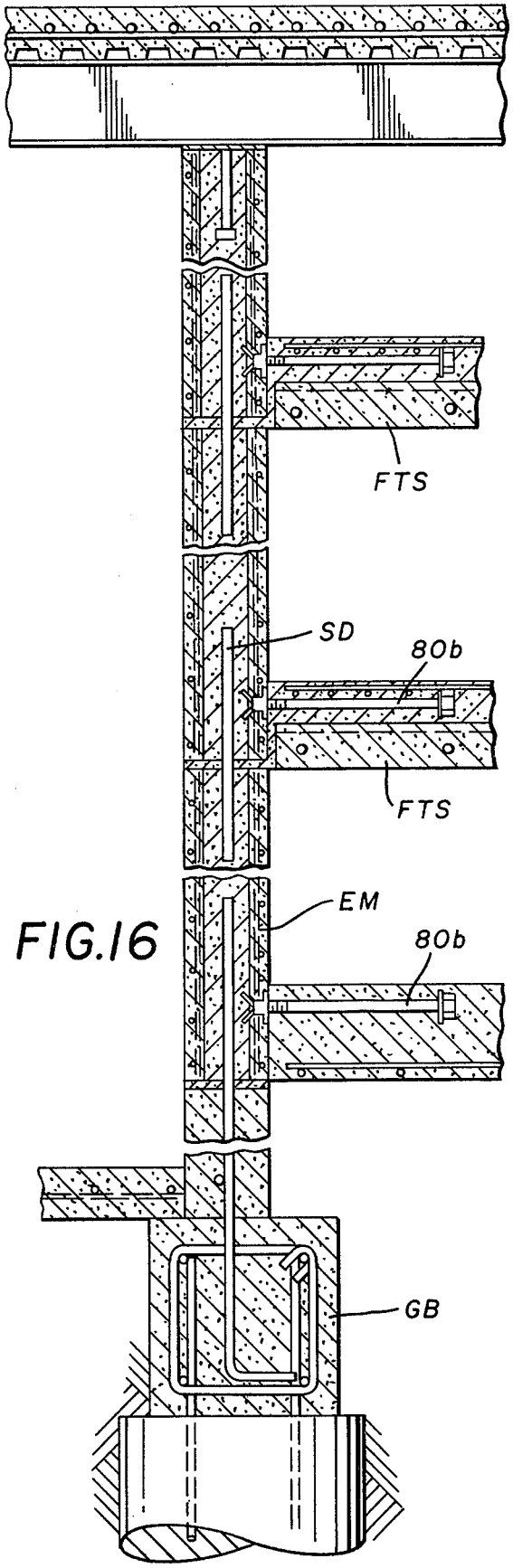
Figure 17:
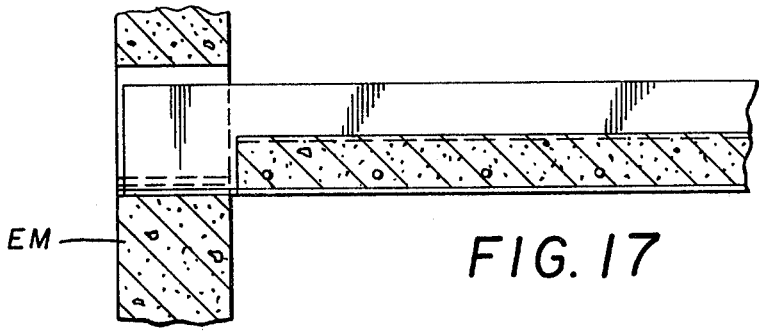

FIGS. 15, 16 and 17 are sectional views taken on the lines 15—15, 16—16 and 17—17 of FIG. 11.

FIG. 18 is a plan view of a typical elevator module.

FIGS. 19, 20, 21 and 22 are sectional views taken along the lines 19—19, 20—20, 21—21 and 22—22 respectively of FIG. 18.

Figures 23, 23A, 24, 25:
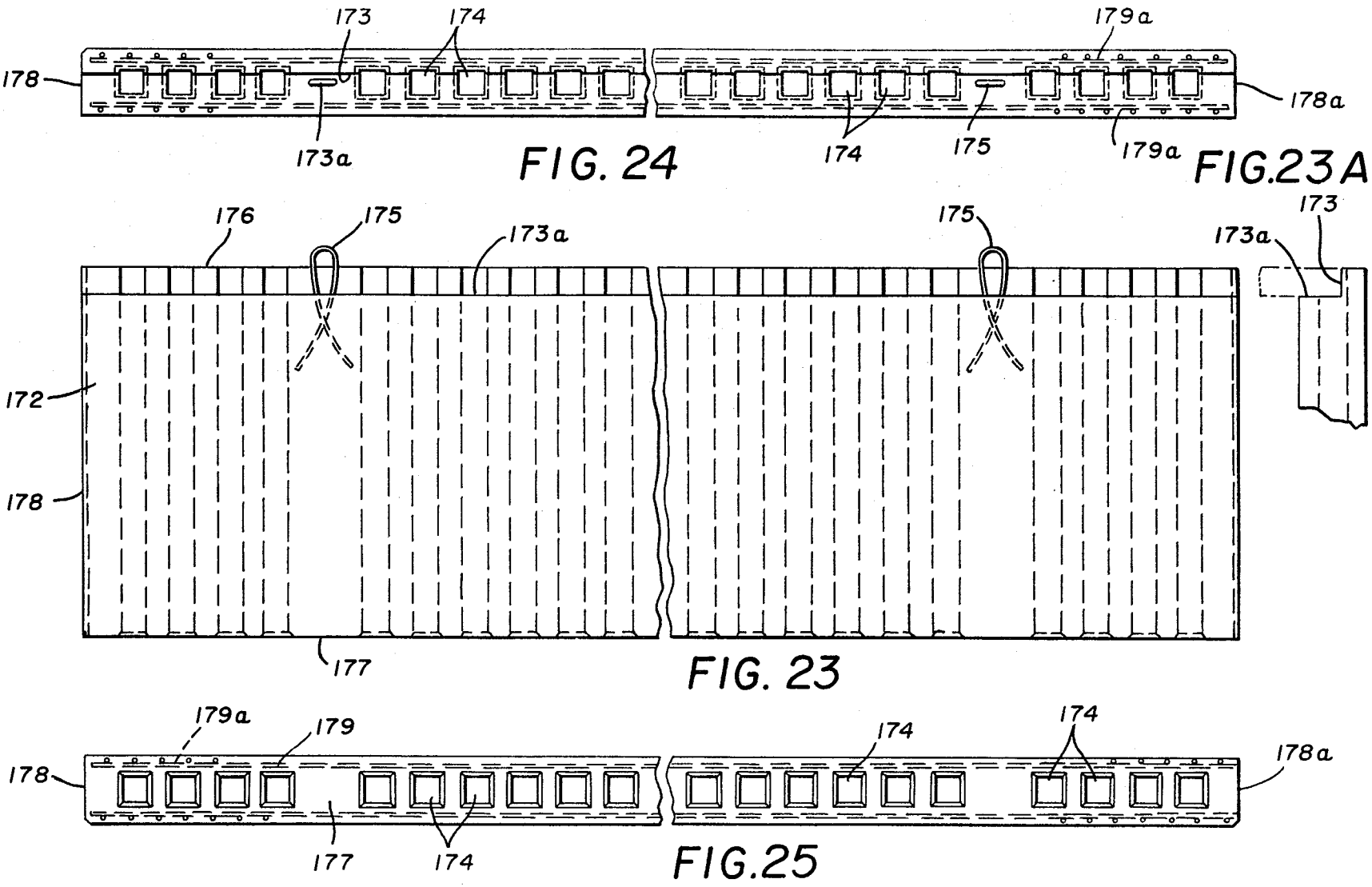

FIG. 23 is an elevational view of a typical end wall member identified in co-related drawings as EW-1.

FIG. 23A is a partial elevational view taken from the right of FIG. 23.

FIGS. 24 and 25 are top and bottom views thereof.

Figure 26:
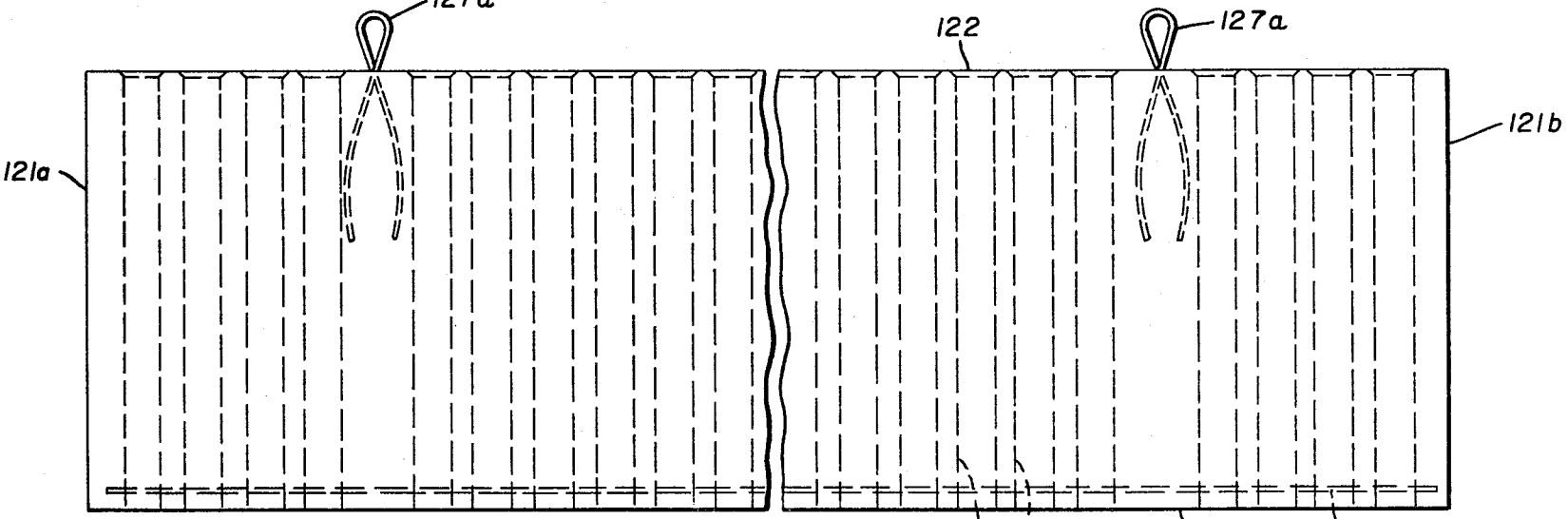

FIG. 26 is an elevational view of a bearing wall identified in co-related drawings as BW-1.

Figure 27:
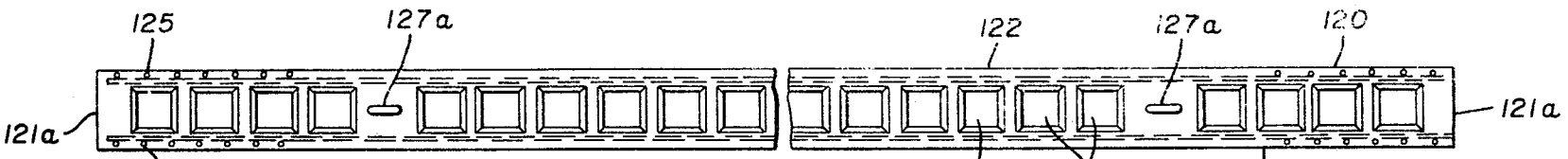
Figure 28:
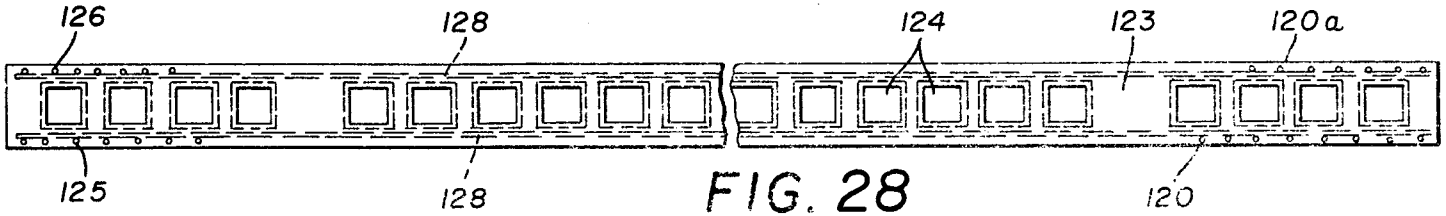

FIGS. 27 and 28 are top and bottom views thereof.

Figure 29:
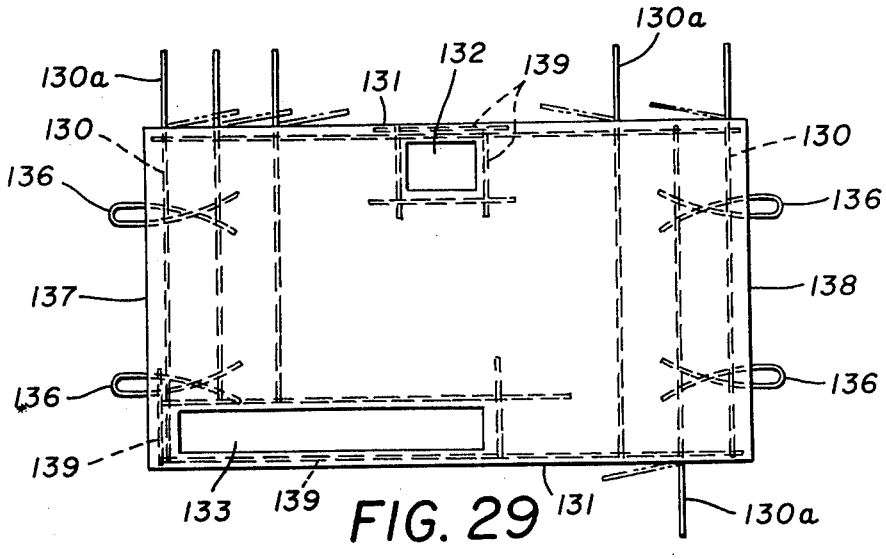

FIG. 29 is a plan view of the heart module slab referred to in co-related drawings as HME-1L.

Figure 30:
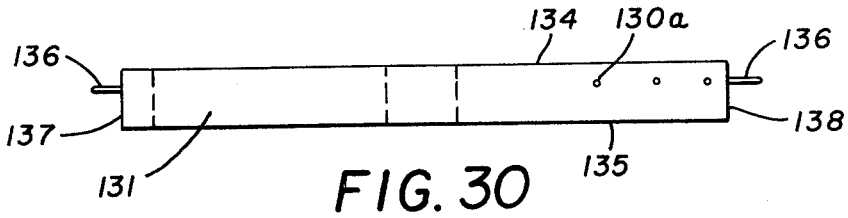

FIG. 30 is a side view thereof.

Figure 31:
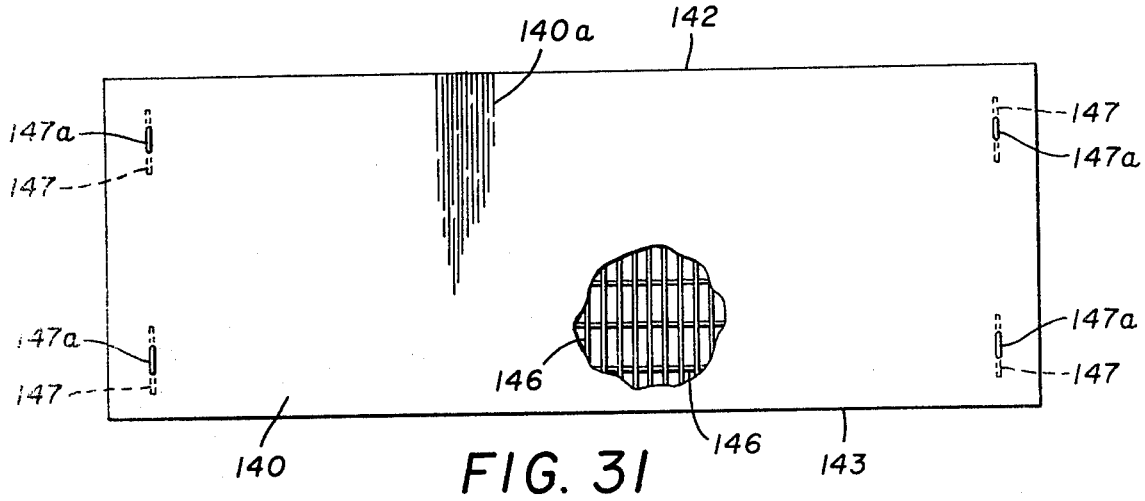

FIG. 31 is a plan view of the floor truss slab hereinafter referred to in co-related drawings as FTS-1.

Figure 32:
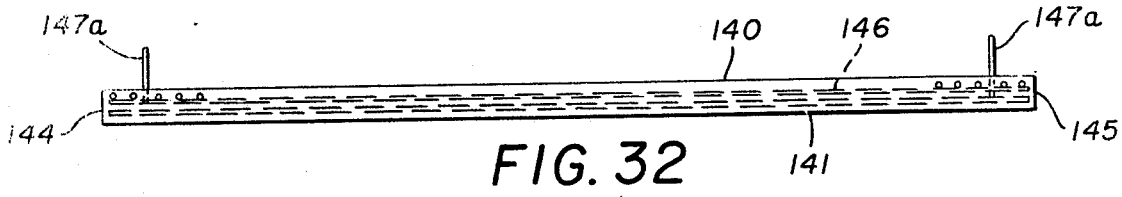

FIG. 32 is an elevational view thereof.

Figure 33:
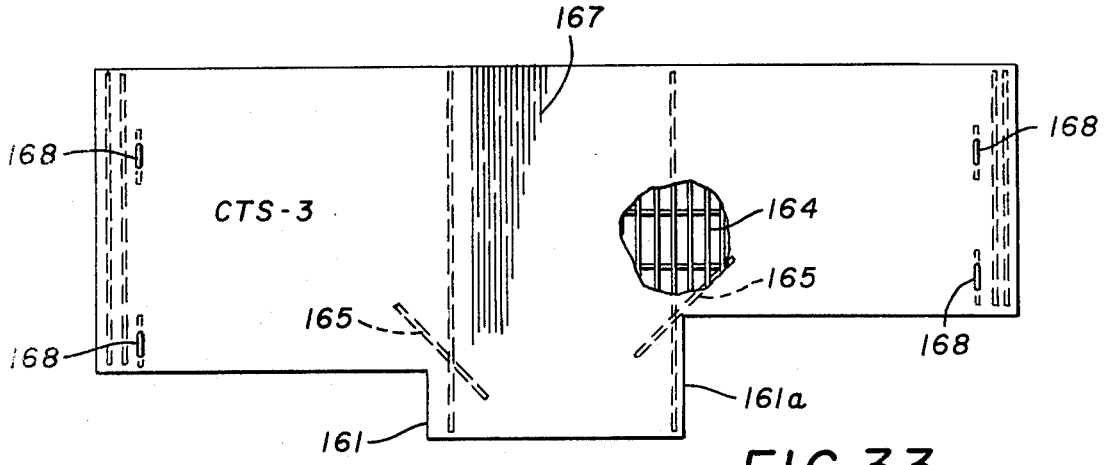

FIG. 33 is a plan view of a corridor truss span hereinafter referred to in co-related drawings as CTS-1.

Figure 34:
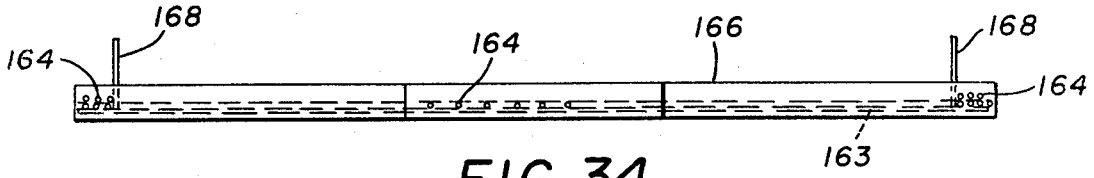

FIG. 34 is an elevational view thereof.

Figure 35:
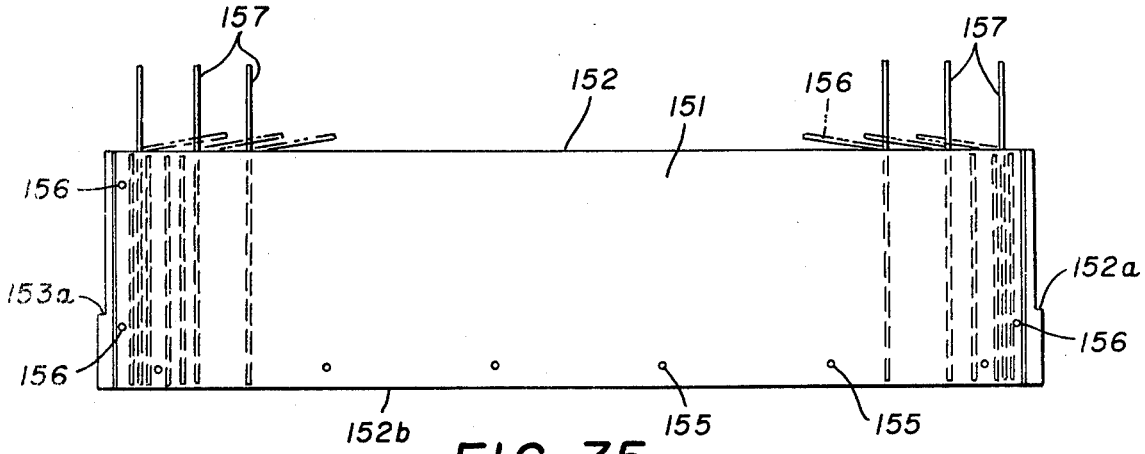

FIG. 35 is a plan view of the balcony slab hereinafter referred to in co-related drawings as BS-1.

Figure 36:
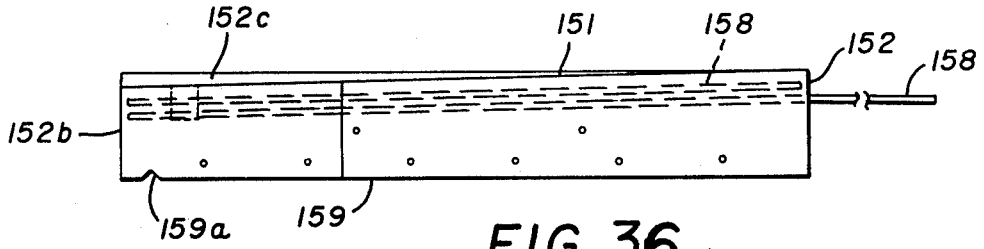

FIG. 36 is an elevational view thereof.

GENERAL DESCRIPTION OF THE SYSTEM

A general understanding of the system can be had by reference to the above-identified Dillon U.S. Pat. No. 3,662,506 and Dillon U.S. Pat. No. 3,906,686 for "Pre-Assembled Utility Module" as well as the presently pending application of Thomas J. Dillon on "Combined Elevator Shaft and Utility Module" filed Apr. 13, 1973, and identified as Ser. No. 351,016 and now U.S. Pat. No. 3,991,528.

In Dillon U.S. Pat. No. 3,662,506, a general description of the system is set forth, and essentially it is shown how there is a combined use of precast concrete and site-poured concrete to achieve a monolithic structure that has reinforcing means embedded within the site-poured concrete following erection and placement of the precast components at the building site.

For clarity in this general description portion of the specification, the principal components of the system will be referred to by their initials. Thus the bearing walls are identified by the letters BW. Thus on certain of the drawings it will be observed that there may appear such diverse designations as FTS-1, FTS-2. This merely indicates a different configuration and dimension of the floor truss slab in plan view.

Also, as has been noted above, certain figures, namely, FIGS. 5, 7, 10, and 11, do not lend themselves to being placed on a single sheet. For these reasons, these are designated as FIGS. 5 and 5A, with match lines A,B being shown on each sheet to indicate the match point of the two drawings.

SPECIFIC DESCRIPTION OF THE SYSTEM

A. FOUNDATION MEANS

Although it is apparent that any one of several conventional foundation means could be employed, the embodiment of the invention shown in the accompanying drawings envisions the use of the so-called "caisson" type of foundation which is best illustrated in FIGS. 7, 7A, and 12 through 17 of the drawings.

Referring to FIG. 7, a typical series of caissons 100, 101, 102, 103, 104, and 105 are positioned in a line so as to support a grade beam 106, for example, with similar grade beams 107, **107*a***, and others that are not numbered being utilized for the purpose of providing a foundation surface that is elevated above grade level as shown in FIGS. 12 through 16.

The grade beam 108 includes the usual reinforcing means 110 that extends downwardly within the confines of the caisson 111 in this instance as shown in broken lines.

A concrete footer 112 positioned on the grade beam 113 serves as a perimeter wall for the field-poured concrete 114. Similarly, the same grade beam could support the opposed ends of a heart module HM positioned in the notched portion thereof.

By the use of this arrangement, the first floor of the building will be comprised, prior to pouring, of heart modules, elevator module, and footers that are supported on grade beams. In this regard it is to be noted that the ends of adjacent heart modules, for example, are slightly spaced apart from each other (see FIG. 13) so that a reinforcing shear dowel 116 can project upwardly. By this arrangement when the first bearing wall 117 is positioned, there will be a void within which the concrete being received in the upper portion thereof during pouring of the second floor can be received, and this will serve to unite bearing wall 117 with respect to the heart modules as shown in FIG. 13.

A similar arrangement exists with respect to the field-poured concrete 114 that is shown in FIG. 12 of the drawings. It is to be understood with reference to FIG. 12 that the field-poured concrete 114 could, of course, partially be replaced by precast slabs much in the manner the remaining floors are completed.

B. DESCRIPTION OF PRECAST COMPONENTS

1. Bearing Walls (BW)

The bearing walls (BW) are best shown in FIGS. 27, 28, and 29 of the drawings.

As will be noted therefrom, each bearing wall is of slab-like configuration so as to include opposed faces 120, **120*a*, opposed ends 121*a*, 121*b*, as well as a top surface 122, and a bottom surface 123. A plurality of vertical square voids 124, 124 extend from the top surface 122 to the bottom surface 123, and it will be noted from the top and bottom views that wire mesh 125 and 126** is positioned on opposed sides of the voids for structural strength purposes during the making of the bearing walls.

Lifting loops 127, **127*a* are provided in the top surface 122** for permitting lifting of these units at the building site as by crane.

Preferably a pair of additional reinforcing rods 128, 128 are provided, with one of these rods being positioned on each side of the vertical voids in close proximity to the bottom surface 123. In use, a nominal width of eight inches is recommended, although it is to be understood that the greater or lesser widths and structural strengths could be utilized if conditions so dictated.

2. Heart Modules (HM)

The heart module is described in detail in the Dillon U.S. Pat. No. 3,906,686 entitled "Pre-Assembled Utility Module" which contains a full and complete description of the heart module concept.

3. Floor Truss Slabs (FTS)

Figure 1:
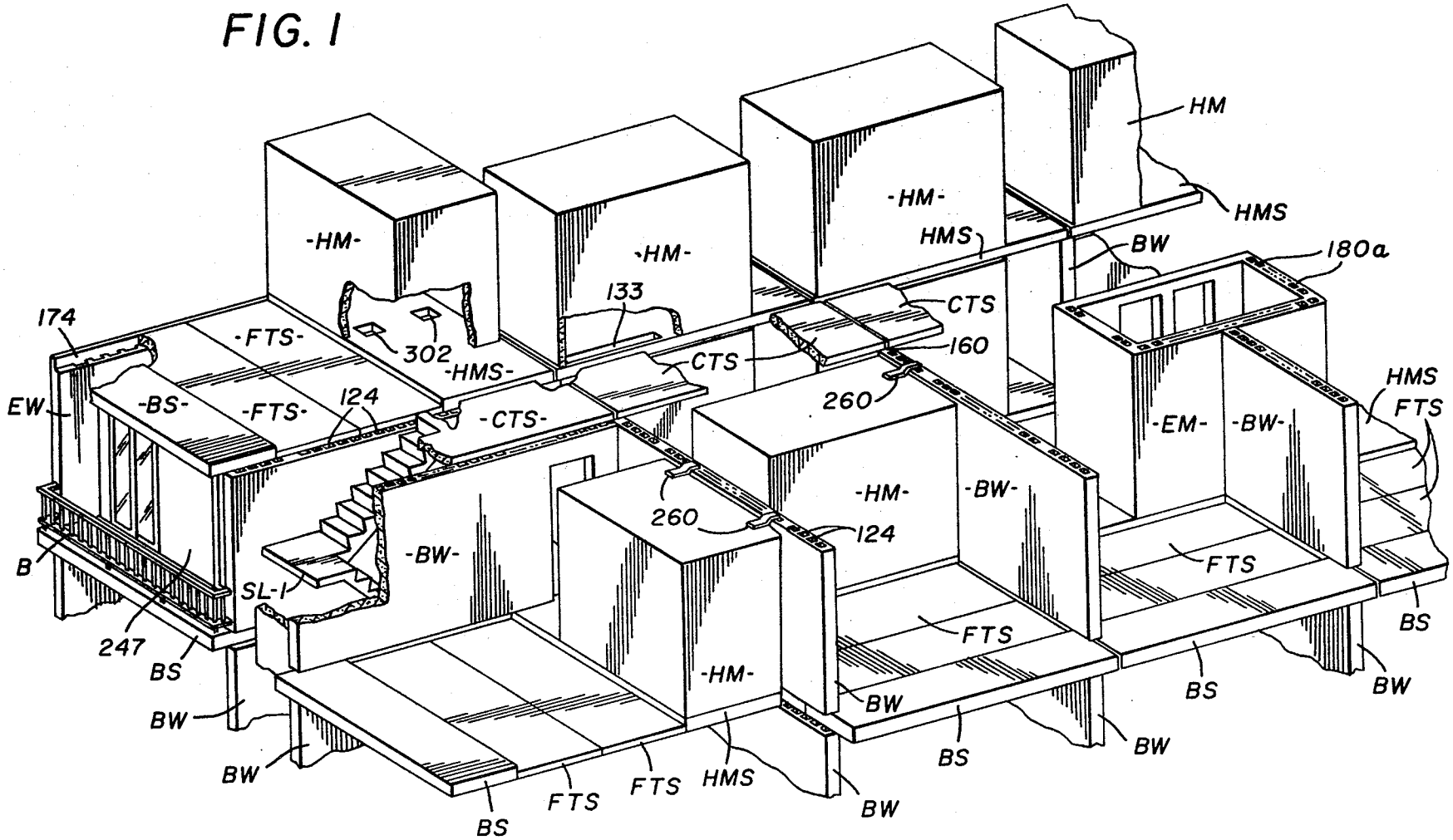
FIG. 1 is an isometric view partially broken away and in section and illustrating the overall concept of the system.

While the heart module slabs just described in connection with FIGS. 29 and 30 have been designated as "full thickness," the floor truss slab shown in FIGS. 31 and 32 is "half thickness" so that when it is placed in transverse abutment with a heart module slab, the members **130*a* thereof can be folded out and lie above the top surface 140** of the adjacent floor truss slab, as best shown in FIG. 1, for example.

4. Balcony Slabs (BS)

Figure 1A:
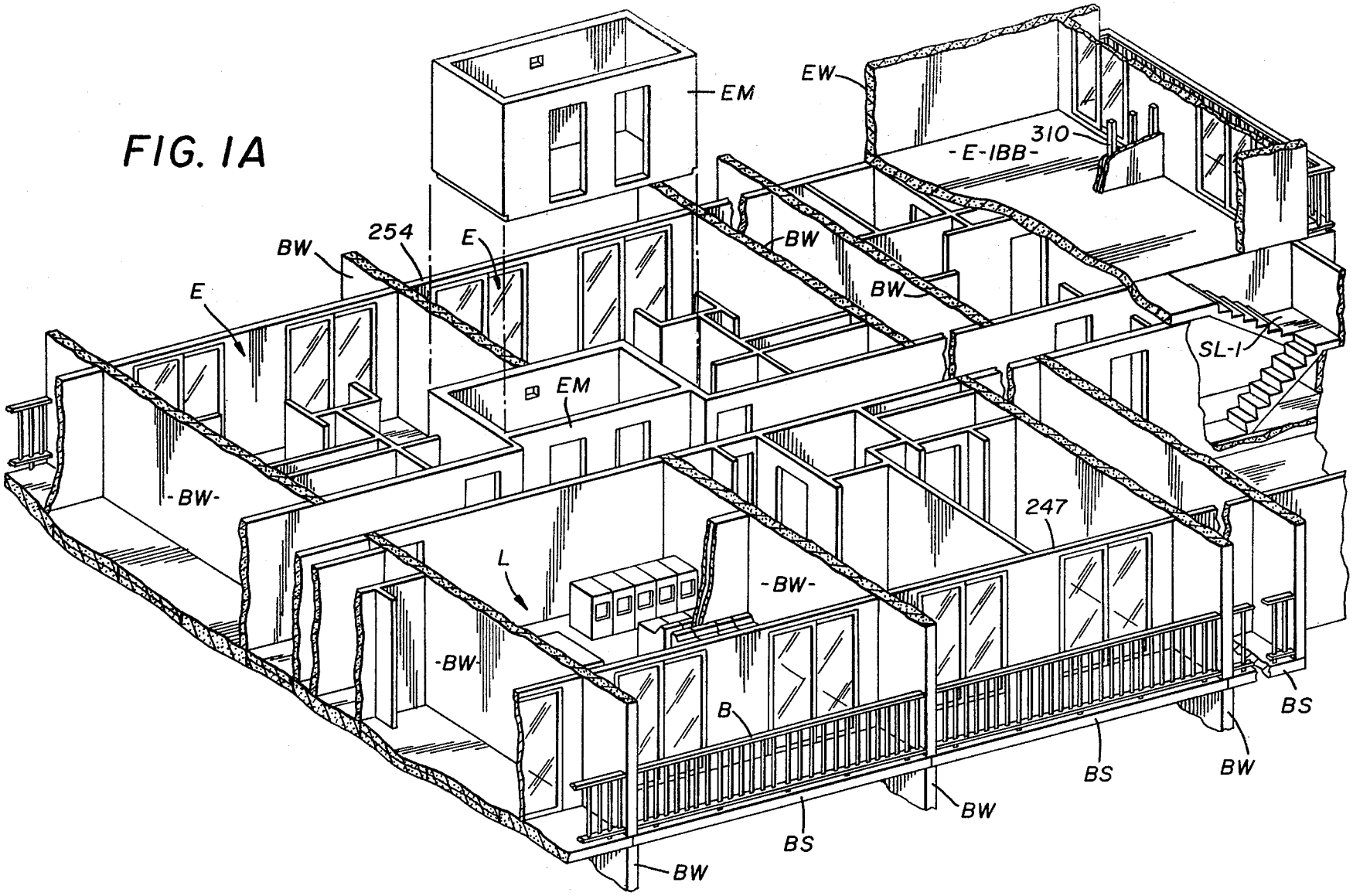
FIG. 1A is a perspective view similar to FIG. 1 but taken from a different angle and showing the structure just below the floor level of the floor that is immediately thereabove.

The construction of the balcony slab (BS) shown in FIGS. 1 and 1A is described in detail in FIGS. 35 and 36 of the drawings to which reference is now made.

It will be first noted that the balcony slabs are "full thickness" so that when they are positioned next to the just described floor truss slabs, as shown in FIGS. 1 and 4, for example, the top surface 151 thereof will be elevated above the top surface of the adjacent floor truss slab, which will be "half thickness" as already described. It will further be noted that this surface 151, as shown in FIG. 36, slopes slightly from rear edge 152 toward the front end **152*b* for drainage purposes, and it will further be noted that the opposed ends 153 and 154 are provided with notches or offsets 152*a* and 153*a*** so that the forward portions will jut beyond the point of support by the bearing wall that is positioned beneath the balcony slab in supporting relationship therewith.

A series of inserts 155, 155 are cast into the upper surface 151 of the slab for the purpose of installing the balcony (B) in known fashion, and furthermore lifting inserts 156, 156 are provided for field insertion of lifting rings for erection purposes.

In addition to the aforementioned component parts, each balcony includes a series of reinforcing rods 157, 157 that project beyond the wall 152 so that the same may be moved to the dotted-line position shown at 156 following positioning in the field, with these extended reinforcing rods then being embedded within the site-poured concrete (SPC) that is poured on top of the adjacent floor truss slab. Additional reinforcing rods 158, 158 are also shown provided in embedded condition beneath the surface 151 as clearly shown in FIGS. 35 and 36 of the drawings. A notch **159*a* is provided in the lower surface 159** for preventing water from dripping onto the porch below.

Each lateral edge has a curb **152*c*** provided thereon for supporting the next bearing wall in the most efficient manner and for preventing the ingress of rain into the dwelling unit.

The heart module slab (HMS) and the balcony slab (BS) can also be referred to as "perimeter slabs" since they define the inner and outer perimeter of each building bay, with the lateral perimeters being defined by the bearing walls (BW).

5. Corridor Truss Slab (CTS) and Corridor Beam (CB)

The construction of the corridor portion of the dwelling unit is best shown in FIGS. 4 and 10A, and first referring to FIG. 4, it will be noted that when the bearing walls have been positioned, there is a space between the same that defines the corridor area of the building as noted in FIG. 4. This space is spanned by a pair of angle members 160, 160 that are known as "corridor beams," with the opposed edges of the corridor beams resting on the opposed ends of the bearing walls as shown in FIG. 4.

The corridor truss slab (CTS) is then positioned on the legs of the corridor beams 160, 160 so as to define the corridor area of the building. Normally and as shown in FIG. 4, the corridor truss slabs will be the first horizontal units positioned following erection of the bearing walls, with this being preferred because it enables the building to be accurately located, and in view of the fact that the modules are sequentially positioned outwardly from the corridor, so to speak, so as to cause the building to grow in width in a progressive fashion, with the heart module first being positioned, following by positioning of the balcony slab, as clearly shown in FIG. 4 of the drawings.

Again it will be noted that the corridor truss slabs are "half thickness" compared to the heart module slabs, with it being noted that the reinforcing members projecting from the heart modules can then be embedded within the field-poured concrete at the time the floor of the building in question is being finished off.

A typical corridor truss slab is shown in FIGS. 33 and 34 and is identified as CTS-3, with the location of this being identified in the structural plan of FIG. 10.

As will be noted, the unit is generally rectangular in plan except that it includes a cutout portion 161 for accommodation of the elevator module and a second cutout portion **161*a* that is intended to accommodate the utility chase 162 shown in FIGS. 5 and 10 of the drawings. In addition to the usual wire mesh 163 that is employed in the construction of this type, there are transversely extending reinforcing bars 164, 164 provided at various positions both at the end and intermediate length thereof as clearly shown in FIGS. 33 and 34, with the diagonal bracings 165, 165** being provided adjacent the inside corridors for reinforcing purposes.

Again, and as in the case of the floor truss slab, the top surface 166 is raked rough as indicated at the numeral 167, and also as in the case of the floor truss spans (FTS), a plurality of wire strand lifting loops 168, 168 are provided adjacent the four corners, with it being noted that the same may be readily folded down and covered when the corridor truss span is covered with concrete during field erection.

6. End Walls (EW)

The construction of the end walls (EW) is shown in detail in FIGS. 23, 24 and 25 of the drawings.

7. Elevator Module (EM)

The detailed construction of the elevator module is set forth in FIGS. 18 through 22 of the drawings, and its association with the remaining components of the building is set forth in FIGS. 10, 10A, 11, 15, 16, and 17 of the drawings.

An elevator module of this type is set forth and disclosed in the co-pending application of Thomas J. Dillon entitled "Combined Elevator Shaft and Utility Module" and filed Apr. 13, 1973, as Ser. No. 351,016 and now U.S. Pat. No. 3,991,528. Reference is made to the disclosure of said application which has been listed as a related application earlier in this specification.

Referring first to the plan view of the elevator module shown in FIG. 18, it will be noted that the elevator shown is a two-elevator unit having a front surface 180, a rear surface 181, and opposed side surfaces 182 and 183, with door openings **184, 184*a* being provided in the front wall 180 for ingress and egress purposes and with the usual elevator doors 185, 185*a* opening and closing with respect to the door openings at the proper time to permit the entry and discharge of passengers from the elevator units which are shown outlined in chain-dotted lines in FIG. 18** and as indicated by the letter E.

As in the case of the bearing walls (BW) and end walls (EW), the elevator module (EM) preferably includes a series of vertical voids within which the site-poured concrete (SPC) may be received.

Referring now to FIGS. 19 and 20, it will be noted that each end wall 182 and 183 has leveling pockets 186, 186 provided therein on the lower edge 187 thereof, with these leveling pockets cooperating with shim means (not shown) that will be placed on the embedded brackets 188, 188 that are embedded in the top wall 189 of the elevator module. This leveling action is described in detail in related U.S. Pat. No. 3,991,528 above-noted, and it will not be repeated herein.

Referring again to FIG. 19, it will be noted that both the front and rear walls are provided with embedded plate members 190, 190, with these plates serving as a point of support for attachment of the I-beam members 191, 191 that are employed for the purpose of supporting elevator guide rail brackets 192, 192 that in turn support the vertical elevator guide rails 193, 193.

As noted in FIG. 18, the interior faces of the end walls 182 and 183 support the remaining guide rails 194, 194 that will be used to guide each of the two elevators shown, with FIG. 20 illustrating how the guide rail supports 195, 195 are secured with respect to the interior of the wall for supporting the guide rails 194, 194, with the same guide rails preferably also supporting the conduit member 196 within which the electrical components may be housed. A limit switch 197 is normally provided at ground floor level only for controlling the descent of the elevator beyond this point.

Figure 22:
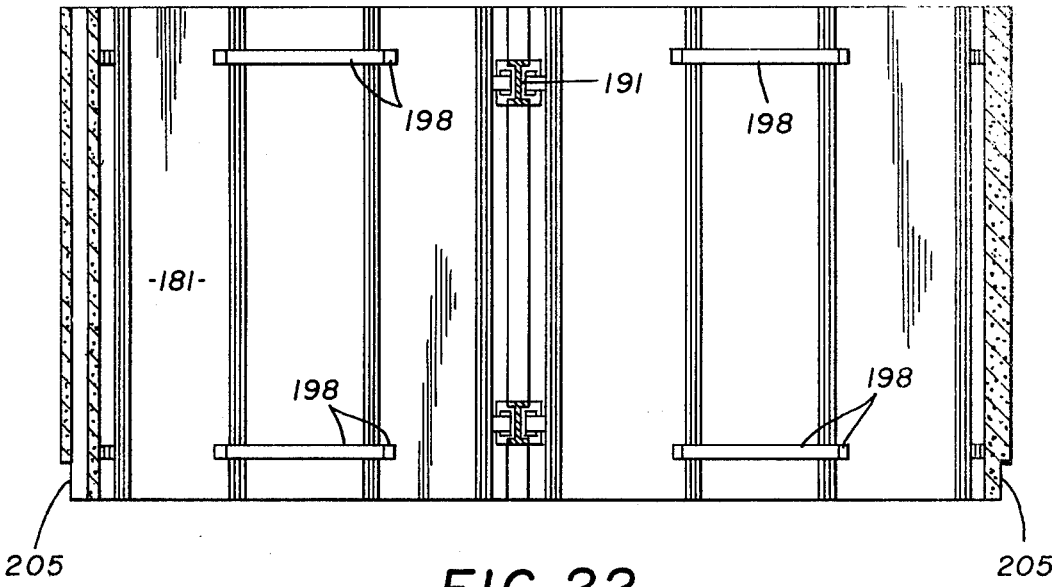

Referring now to FIG. 22, it will be noted that the inside surface of the rear wall 181 also supports a counter-weight guide rail and brackets that are indicated generally by the numeral 198, with the usual counterweight 199 (see FIG. 19) being encased therein and moving upward and downward in conventional fashion.

Figure 21:
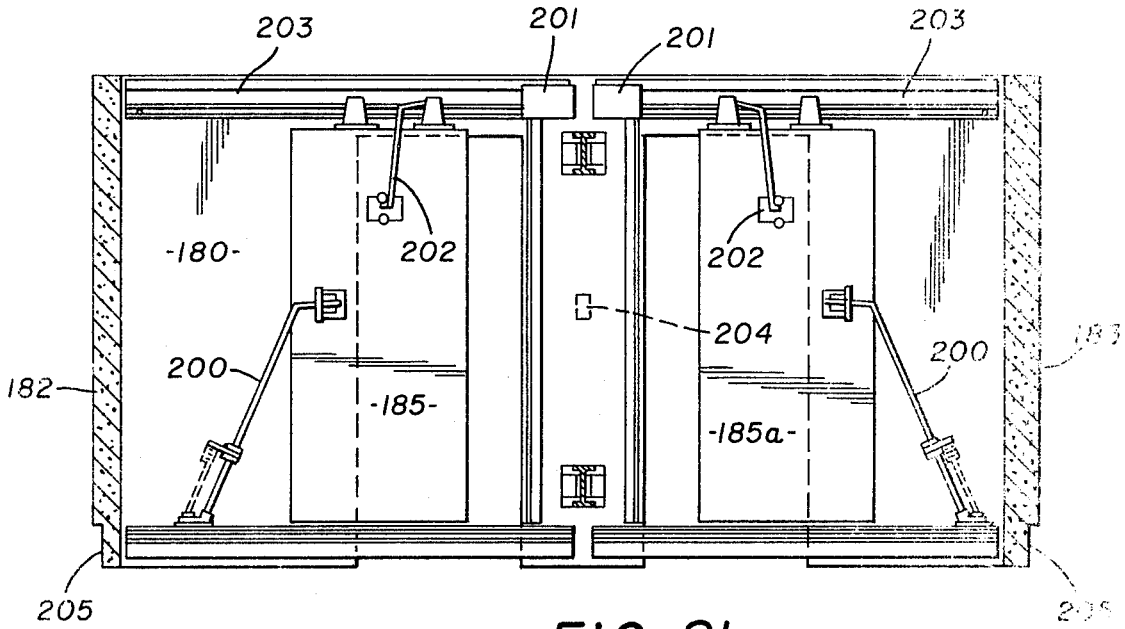

Referring now to FIG. 21 for a further description of the elevator door mechanisms, it will be noted first that a pair of spring door closing mechanisms 200, 200 are provided for each door, with motor interlocks 201, 201 preventing opening of the doors until such time as the motor roller release assembly 202 has been properly positioned to indicate that the door can be safely opened.

The usual guide rails 203, 203 are provided in each instance to permit the door to freely move into and out of closed position upon operation of the usual control 204.

Notches 205, 205 extend transversely of each end wall 182 and 183 for the purpose of coacting with the heart modules that are shown disposed adjacent thereto in FIG. 11 of the drawings.

In this regard the position of the elevator modules in stacked or assembled condition is shown best in FIGS. 8 and 9 of the drawings where this feature is clearly illustrated, with the heart module received within the notch 205 so as to be supported on the top edge 189 of the elevator module immediately beneath the one shown in FIG. 8.

With regard to the assembly of the elevator module after positioning, the wall voids **180*a*, 180*a* are filled and the shear dowels (SD) positioned therein (see FIGS. 8 and 9) in a manner similar to erection of the bearing and end walls, with the floor being subsequently poured as shown in FIG. 16 and with reinforced rod 80*b*** being used in known fashion.

One of the advantages of the invention is that assembly can essentially be completed prior to lifting of the module into place. This permits much of the time-consuming work to be done on the ground in advance of being lifted into erection position, and by this arrangement it has been found that the elevator can be dropped into the top of the elevator shaft very shortly after placing of the last elevator module in place. This, in effect, materially reduces the overall construction time considerably.

8. Stair Landings (SL)

The precast stair bindings (SL) are shown in FIGS. 1 and 1A of the drawings and will not be described in detail.

9. Roof Corridor Truss Spans (RCTS), Roof Truss Slabs (RTS), Roof Balcony Slabs (RBS), and Roof Heart Module Slabs (RHMS)

The roof framing plan is shown in FIGS. 11 and 11A of the drawings. Since the roof of the building in question is essentially no different than any remaining portion of the building, a detailed description of the individual roof elements will not be undertaken.

Suffice it to say that the roof members, in general, correspond to their counterparts on the other floors of the building.

C. NON-PRECAST COMPONENTS

1. Reinforcing Steel

Although the majority of the precast components above-described have reinforcing means provided therein at the time of delivery to the building site, several different types of reinforcing means are field-positioned and subsequently embedded within the structure during the field pouring of concrete in a manner that will now be described.

Figure 2:
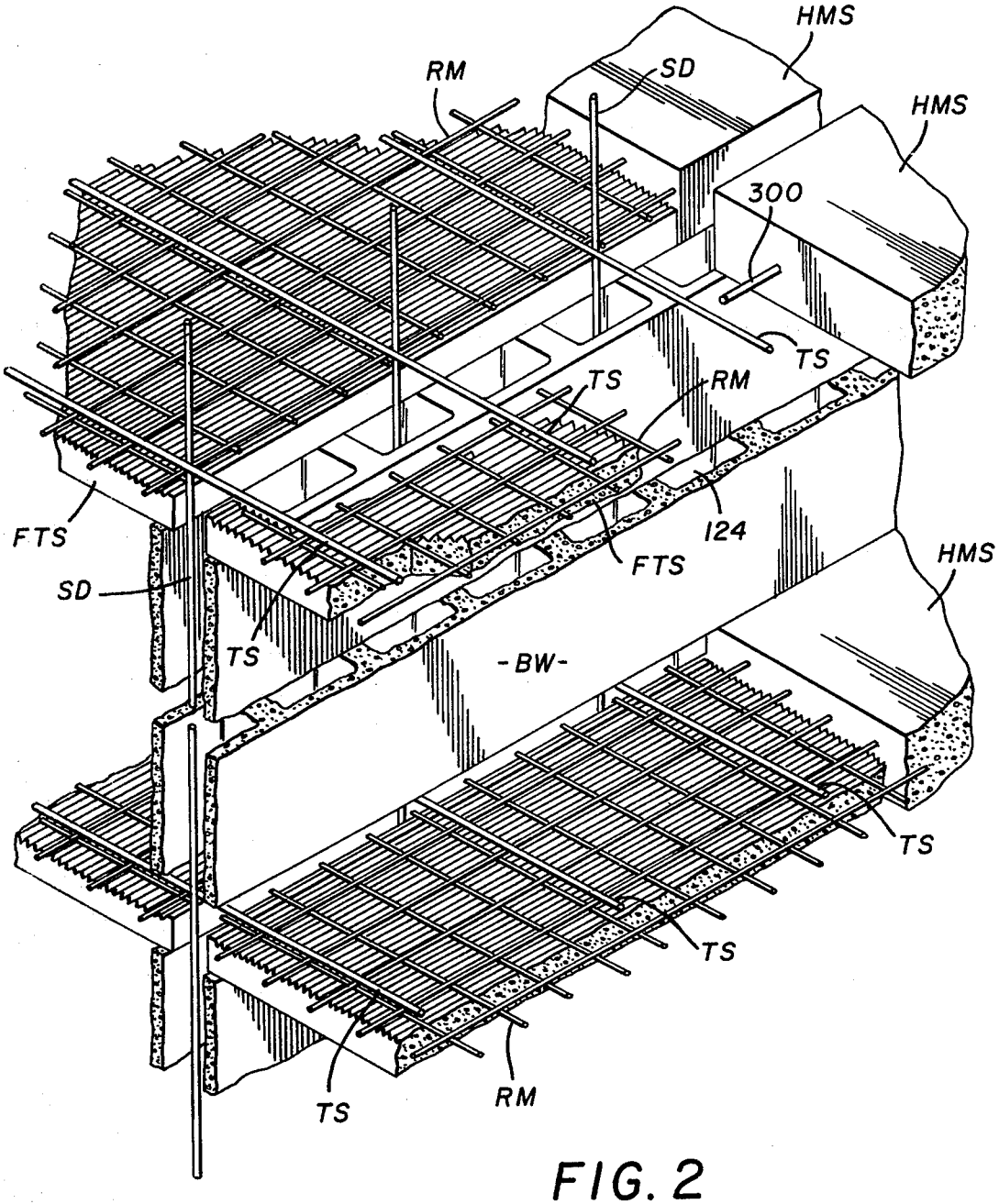
FIG. 2 is a similar isometric view but partially exploded for the purpose of clarity.

In this regard reference is first made to FIG. 2 of the drawings wherein the general arrangement of positioning the reinforcing means is most clearly illustrated. Again, abbreviations will be used to designate the component parts.

Figure 3:
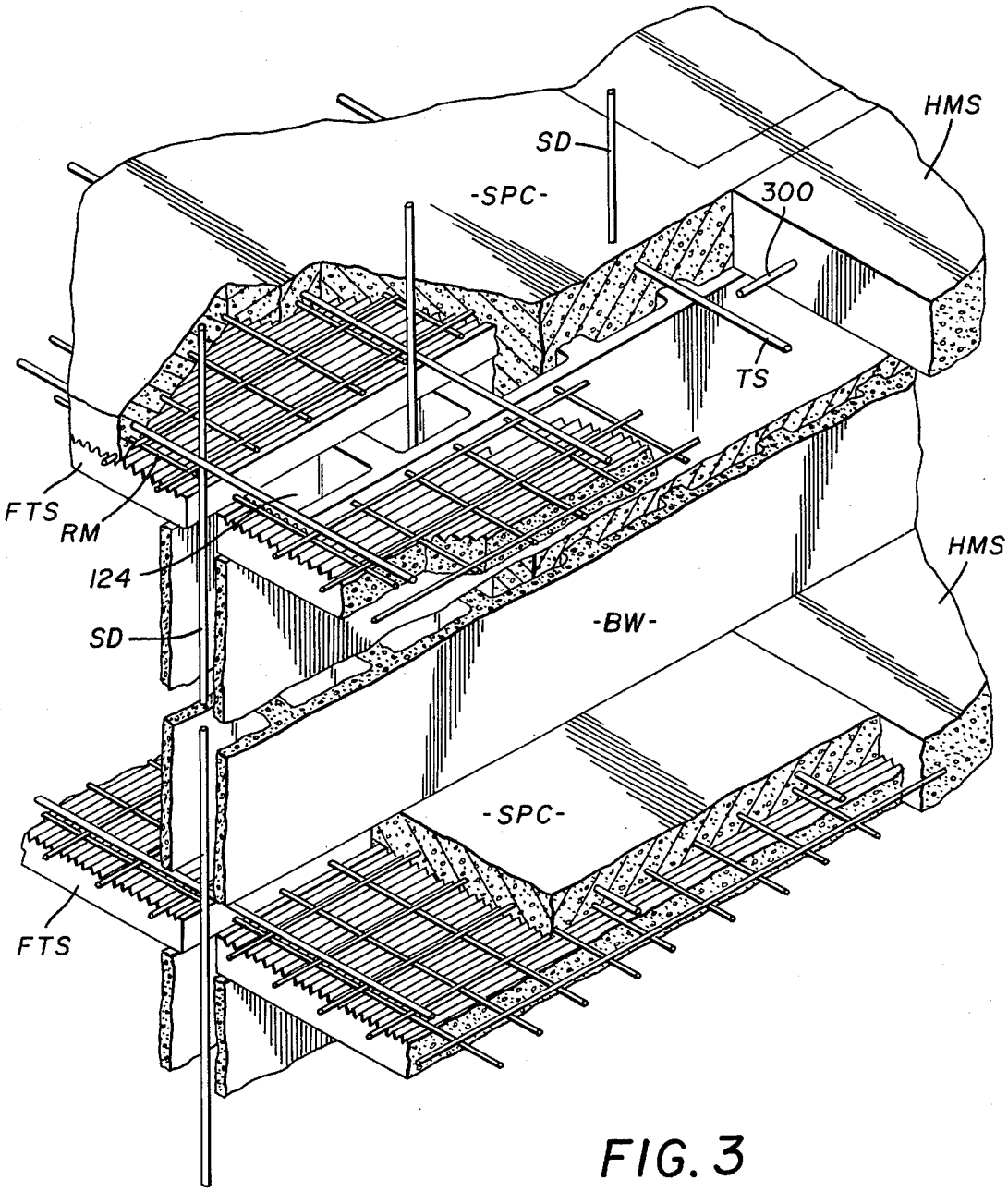

In each instance of use, shear dowels (SD) are positioned within the vertical voids 124, 124 of the bearing wall (BW) (FIGS. 12, 13 and 14) in the manner shown in FIGS. 2 and 3, as well as into the vertical voids 174, 174 of the end wall and the vertical voids **180*a*, 180*a* of the elevator module (FIGS. 15 and 16**).

In this regard, and in each instance referring to the above-noted drawings, the shear dowel is positioned in the void after the same has been partially filled with concrete in the field, and the shear dowel is generally approximately four foot in length so that two feet will be inserted within the bearing wall, end wall, or elevator module wall that has been filled with field-poured concrete, while two feet will project above the same much in the manner shown in FIG. 3 of the drawings wherein the field-poured concrete has been poured to the floor level.

When the next bearing wall is positioned on top of the floor surface for erection of a subsequent floor, the part of the shear dowels that are projecting in FIG. 3 will ultimately be covered and embedded within concrete poured within the voids of the subsequently positioned bearing wall.

Also utilized in each instance is conventional reinforcing mesh (RM) which is laid over the exposed surfaces of the positioned floor truss spans (FTS) as shown in FIG. 3. Said mesh would also be employed over the top of the corridor truss spans (CTS) which are not shown in either FIGS. 2 or 3. This mesh is ultimately embedded beneath the surface of the floor that is poured in the field.

Additionally and as shown in FIGS. 2 and 3, field-positioned tension steel (TS) is employed by being positioned over the mesh so as to interconnect adjacent floor truss slabs in the manner shown in FIG. 2 of the drawings. Tension steel is generally of bar stock and serves to provide a tension force between adjacent living units.

Referring next to FIG. 14 as a typical example, it will be noted that there is also provided an angular reinforcing steel (ARS) that is used in the roof section of the building, with this member ultimately being embedded within the concrete poured on the roof portion of the building, with one leg being inserted in the voids of the bearing wall, end wall, or elevator module as the case may be.

In certain areas having a high incidence of earthquakes and ground tremors, provision is made for the use of seismic steel in addition to the conventional shear dowels (SD) previously described. Seismic steel is long length bar stock (e.g. 10 ft.) that is again inserted within the voids of the bearing wall much in the manner that the shear dowels are inserted. However, the seismic steel is joined end-to-end throughout the height of the building as by cadwelding, threading, or like means, to provide a continuous, unbroken rod.

In instances where seismic steel is used, the same will normally be used in a ten foot length, with the bearing wall being slipped down over the projecting portion thereof, and with the same again being embedded within concrete much in the manner that the shear dowels are embedded.

Also, in certain areas of the building, such as the community areas on the first floor which span several bays, it will be necessary to use something other than a bearing wall in this area.

2. Penthouse (P)

The penthouse unit (P) is shown best in FIG. 8 of the drawings where it will be noted that the same is a steel framed building positioned on top of the uppermost elevator module (EM) so that the equipment required to operate the elevators can be housed therein. The construction thereof employs the conventional framing elements, and no invention per se is claimed with respect to the penthouse (P) which is merely made to house the equipment required to operate the elevators.

3. Typical Floor Plans

A typical floor plan is shown in FIGS. 5 and 5A of the drawings, which match lines A, B being provided on these drawings to show the point of match between the two sheets of drawings.

As will be seen from FIGS. 5 and 5A, each floor includes stair landings SL-1 and SL-2, as well as an elevator module as shown in FIG. 7. In the plan shown in FIG. 5, each floor is essentially made up of one-bedroom units, with the end one-bedroom units being designated by the numeral E-1BR, the conventional one-bedroom units being designated by the numeral 1BR, and the efficiency units being designated by the numeral E. A laundry (L) shown in FIG. 5 is located on one or more floors of the building, while one or more utility chases (UC) are provided on each floor for reception of conventional conduits, trash disposal, and the like.

D. ERECTION PROCEDURE

Although much of the erection procedure and techniques have been set forth in the foregoing detailed description of component parts, a sequential step-by-step recitation of the erection steps will now be discussed in detail.

1. Site Preparation And Completion Of Foundation Means

Before any of the precast components can be positioned, it is, of course, necessary to first have the foundation properly prepared. Included in this operation will, of course, be the site preparation to the extent necessary to accommodate sewers, water, and other utilities along with proper grading.

During this preparation and referring to FIG. 7, the first physical objects installed are the caissons, such as the caissons 100 to 105 shown in FIGS. 7 and 7A of the drawings, with such caissons first being driven to the appropriate depth and then filled with concrete and reinforcing rods in the fashion shown best in FIGS. 12 to 17.

As shown in these figures and also in FIGS. 7 and 7A, grade beams, such as grade beams **107*a*, 107, are supported on the caissons for the purpose of supporting heart module units between parallel adjacent grade beams, with a typical heart module being positioned initially as shown in FIG. 7 in chaindotted lines spanning the space between the parallel grade beams 106 and 107**.

The final step in preparing the foundation is the pouring of the frost walls **109, 109*a*, 109*b*, 109*c* (FIG. 7), and 109*d* and 109*e* (FIG. 7A**), and any remaining frost walls for the non load bearing walls of the building.

When this operation has been completed, the enclosed portion of the building is provided with the appropriate gravel which is then compacted to obtain the density needed to provide sub-surface to the concrete that will subsequently be poured.

2. The First Floor

At this time and with work completed on the foundation, erection of the first floor of the building is commenced by first positioning the heart modules in spanning relationship to the grade beams, much in the manner as illustrated in FIG. 7 of the drawings.

It will also be noted from FIGS. 8 and 9 that the elevator module pit (EMP) has been located on the caissons that support the same, and at this time the first floor elevator module (EM) can be positioned thereon as clearly shown in FIGS. 8 and 9.

It will also be assumed that during the preparation of the foundation, the reinforcing rods, such as the rod 275 shown in FIG. 14, have been positioned, and at this time it is merely necessary to pour the site-poured concrete (SPC) floor to the level of the ground floor elevation as defined by the top of the positioned heart module slab (HMS).

When the concrete floor surface of the first floor of the building has set to the requisite degree of hardness, the bearing walls (BW) for the first floor may be positioned over the upwardly projecting rods 275, 275.

As soon as the bearing walls for the first floor have been positioned as just described, the second floor elevator will be placed, and following this the corridor beams 160, 160 will be positioned on the inboard ends of the spaced-apart bearing walls (BW) as shown in FIG. 4, for example, and then secured in place.

Following this, the corridor truss slabs (CTS) will be positioned in spanning relationship between adjacent corridor beams 160, 160 so that a temporary center portion of the building now exists, with it being noted that as earlier mentioned, the building will grow outwardly from side-to-side hereinafter.

Again referring to FIG. 4, the heart modules (HM) are positioned on opposed sides of the corridor truss span (CTS), with normal procedure being to position all heart modules (HM) first along the corridor, followed by positioning of the floor truss slabs (FTS) and the balcony slabs (BS) in that order until the building has grown outwardly to its full width.

As mentioned earlier, the all-thread bolts 300 shown in FIG. 4 will be positioned or, alternatively, the reinforcing rods 130, 130 shown in FIGS. 29 and 35 will be bent outwardly so as to be disposed in a position above the surface of the corridor and floor truss slabs (CT, FTS) but beneath the final finish floor level, which is represented by the top surface of the heart module slab (HMS) and the top surface of the balcony slab (BS).

During the period that the ceiling of the first floor is being completed, the second floor elevator module (EM) has been installed on top of the first floor elevator module, and also during this same period when the various slabs (HMS, CTS, FTS, BS) are being positioned to form the floor of the second floor of the building, the precast stair landings SL-1 and SL-2 can be installed with this condition being schematically illustrated in part in FIG. 1 of the drawings.

All slabs to receive structural topping are shored at mid-point of their span. Shoring heights are adjusted so the bottom of the slabs match that of the adjacent heart module slabs (HMS) and balcony slabs (BS).

When all of the components have been positioned as just described, the dwelling will have an appearance substantially similar to that shown in FIGS. 1, 10 and 10A, and at this time the next step will be to pour the vertical voids of the bearing walls (BW), the end walls (EW), and the elevator module (EM) for the first floor.

One point that should be observed with respect to the positioning of the just described walls is that the same are normally shimmed so as to be spaced approximately ½ of an inch off of the floor surface upon which the same are supported. This is done for the reason that it permits the gravitationally descending concrete within the voids of the bearing and end walls to force out the air and thus avoid any voids, with it being possible to observe the emitting concrete on the floor level below that on which the pour is being made. Normally these shims are of asbestos material and also serve the dual purpose of permitting very fine adjustment as to leveling, etc.

Preferably the concrete is poured in the voids of these vertical walls to about a point two or three inches beneath the top surface thereof. At this time and after appropriate hardening has taken place within the voids, the shear dowels (SD) are inserted to a depth of about two feet within the concrete that has just been poured within the voids of the bearing wall (BW), end wall (EW), and elevator module (EM) (see FIGS. 12 to 16).

Also at this time the tension steel (TS) is placed over the voids in a horizontal mode, and also the reinforcing mesh (RM) is positioned over the floor truss slabs (FTS), corridor truss slabs (CTS) and also over the top of the vertical voids that have just been poured with concrete.

At this time site-poured concrete (SPC) can be poured over the floor truss slab (FTS) and corridor truss slabs (CTS) and the vertical voids filled, floated, and otherwise raised to the level of the balcony slabs (BS) and heart module slabs (HMS) so as to produce a finished floor.

When the second floor portion of the second floor of the unit has been completed to the extent just described, the sequence of events would then be repeated by first positioning the bearing walls (BW) thereon, followed by installation of the third floor corridor beams 160 and the corridor truss slabs (CTS) which are positioned on the beams. Following this, installation of the third floor heart module (HM), elevator module (EM), floor truss slabs (FTS), and balcony slab (BS) may be done, with this process being repeated until the roof portion of the building has been completed.

During work upwardly on the building, at each floor the precast stairs SL-1 and SL-2 and elevator modules (EM) are progressively inserted as the building progresses so that when the building is topped out, the stairs and elevator portion of the building are substantially completed, having been fitted with hardware as the work progressed upwardly.

Accordingly, it is merely necessary to lift the entire elevator cab unit by crane into the elevator shaft, and following appropriate blocking and shoring of the same within the shaft, the elevator penthouse can be placed over the elevator shaft, and the equipment therein attached to the elevator for operation substantially coincident with the topping out of the building.

CONCLUSION

It will be seen from the foregoing that there has been produced a new and unique total building system that constitutes an innovative marriage between precast components, reinforcing steel, and site-poured concrete to achieve an extremely strong, highly unitized building that is capable of being erected in minimal time and with minimal expense.

While a specific order of erection has been set forth specifically in the preceding paragraphs, it follows that delivery delays and other delays may necessitate the procedure being somewhat interrupted and taken out of turn. However, the overall procedure generally follows the steps of first pouring the vertical walls, then positioning the horizontal slabs, followed by pouring of a floor surface.

It will also be noted that added safety to the workmen is another advantage of this invention since at all times during construction the workmen have a solid surface upon which to perform their duties. There never exists a situation where they are working on scaffolding or other temporary structures of this nature, and thus an additional degree of safety is present.

While a full and complete description of the invention has been set forth in accordance with the dictates of the Patent Statutes, the invention is not intended to be limited to the specific form recited herein.

Accordingly modifications of the invention may be resorted to without departing from the spirit hereof or the scope of the appended claims.

What is claimed is:

1. In combination with a multi-story building which includes vertical load-bearing walls having vertical voids extending from top to bottom thereof and full and partial thickness floor slabs adapted to rest on and span the distance between said walls and site-poured concrete simultaneously received on said partial thickness floor slabs and within said voids of said walls, the improvement comprising precast elevator modules arranged vertically with respect to each other, each comprising;

(A) opposed front and rear walls;

(B) opposed end walls integrally joined to and interconnecting said front and rear walls, thereby forming an elevator-receiving compartment;

(C) said front wall having at least one door opening therein;

(D) said walls having top and bottom edges with said bottom edges being supported in slightly spaced relationship with said top edges of the next preceding module;

(E) each of said walls having at least one through vertical void therein extending from the top edge to the bottom edge thereof for reception of said site-poured concrete that is received on said partial thickness floor slabs;

(F) said end walls having transversely extending locating notches in the bottom edges thereof for engagement with and support on the full thickness floor slabs;

(G) said full thickness floor slabs being received on the top edge of the end walls of the next preceeding module;

(H) said partial thickness floor slabs disposed adjacent the top edges of the side walls of the next preceeding module;

(I) said site-poured concrete covering said partial thickness floor slabs and filling the space between vertically adjacent modules and said voids; and (J) said end walls having three dimensional leveling pockets disposed on their lower edges and embedded brackets adjacent their upper edges with said embedded brackets and said levelling pockets of vertically adjacent modules cooperating for leveling and attachment purposes.

* * * * *